US008132308B2

(12) United States Patent
Foley

(10) Patent No.: US 8,132,308 B2
(45) Date of Patent: Mar. 13, 2012

(54) FASTENER EXTRACTION TOOL

(76) Inventor: Michael J. Foley, Hailey, ID (US)

( * ) Notice: Subject to any disclaimer, the term of this patent is extended or adjusted under 35 U.S.C. 154(b) by 262 days.

(21) Appl. No.: 12/710,547

(22) Filed: Feb. 23, 2010

(65) Prior Publication Data

US 2010/0148137 A1 Jun. 17, 2010

Related U.S. Application Data

(63) Continuation-in-part of application No. 12/169,095, filed on Jul. 8, 2008, now Pat. No. 7,950,627, which is a continuation-in-part of application No. 11/972,742, filed on Jan. 11, 2008, now Pat. No. 7,703,748.

(60) Provisional application No. 61/154,548, filed on Feb. 23, 2009, provisional application No. 61/218,199, filed on Jun. 18, 2009, provisional application No. 61/003,834, filed on Nov. 20, 2007.

(51) Int. Cl.
*B25B 9/00* (2006.01)

(52) U.S. Cl. ..... 29/268; 29/270; 254/21; 254/28; 81/418

(58) Field of Classification Search ..... 29/268, 29/270, 275, 278; 254/21; 81/418, 415, 81/300, 427.5; 7/132
See application file for complete search history.

(56) References Cited

U.S. PATENT DOCUMENTS

| | | | |
|---|---|---|---|
| 143,496 | A | 10/1873 | Capewell |
| 600,082 | A | 3/1898 | Krutsch |
| 715,915 | A | 12/1902 | White |
| 795,876 | A | 8/1905 | Willhide |
| RE12,458 | E | 2/1906 | Baggett |
| 840,580 | A | 1/1907 | McMillan |
| 885,816 | A | 4/1908 | Weyeneth |
| 929,821 | A | 8/1909 | Bonner |
| 1,293,966 | A | 2/1919 | Springer |
| 1,382,109 | A | 6/1921 | Matsler |
| 1,495,028 | A | 6/1924 | Mitchell |
| 1,532,147 | A | 4/1925 | MacPherson |
| 1,644,352 | A | 10/1927 | Perrin |
| 1,949,335 | A | 2/1934 | Settles |
| 1,989,918 | A | 2/1935 | Drypolcher |
| 2,313,530 | A | 3/1943 | Feigion |
| 2,336,961 | A | 12/1943 | Russell |

(Continued)

FOREIGN PATENT DOCUMENTS

JP 06-066973 U 9/1994

(Continued)

OTHER PUBLICATIONS

PCT Search Report; PCT/US2008/083972; May 28, 2009; 18 pages.

(Continued)

*Primary Examiner* — Lee D Wilson
(74) *Attorney, Agent, or Firm* — Brown & Michaels, PC

(57) ABSTRACT

The hand tool is used to extract a fastener from a material by preferably gripping the fastener from a horizontal orientation. The hand tool has a head with two pivotally joined halves including at least one pair of gripping jaws. The tool head preferably includes tips that may be used to dig beneath a fastener head that is flush with or set below a surface. The tool includes a pair of handles operable to close the gripping jaws. The handles are preferably offset above the plane of the tool head such that they operate as a lever in cooperation with a fulcrum on the bottom of the tool head to extract the fastener.

19 Claims, 20 Drawing Sheets

U.S. PATENT DOCUMENTS

| | | | |
|---|---|---|---|
| 2,462,250 | A | 2/1949 | Andrews |
| 2,501,500 | A | 3/1950 | De Armond |
| 2,578,230 | A | 12/1951 | Davis |
| 3,150,666 | A | 9/1964 | Averbach |
| 4,953,248 | A | 9/1990 | Trombetta |
| 5,150,488 | A | 9/1992 | Yuan et al. |
| D356,238 | S | 3/1995 | Moore et al. |
| 5,575,029 | A | 11/1996 | Simpson |
| 5,611,519 | A | 3/1997 | Garcia |
| 5,636,398 | A | 6/1997 | Fike |
| 6,088,920 | A | 7/2000 | Schmick |
| 6,105,935 | A | 8/2000 | Wagner |
| 6,202,517 | B1 | 3/2001 | Dolan |
| 6,223,373 | B1 | 5/2001 | Yeh |
| 6,314,599 | B1 | 11/2001 | Hay |
| 6,701,560 | B2 | 3/2004 | Foley |
| 6,733,001 | B2 | 5/2004 | Wagner |
| 6,772,765 | B2 | 8/2004 | Scheller et al. |
| 6,826,831 | B2 | 12/2004 | Crawley |
| 7,249,752 | B1 | 7/2007 | Foley |
| 7,703,748 | B2 * | 4/2010 | Foley ..... 254/23 |
| 7,950,627 | B2 * | 5/2011 | Foley ..... 254/21 |
| 2009/0126539 | A1 * | 5/2009 | Foley ..... 81/418 |
| 2009/0127521 | A1 * | 5/2009 | Foley ..... 254/21 |
| 2010/0148137 | A1 * | 6/2010 | Foley ..... 254/23 |

FOREIGN PATENT DOCUMENTS

| | | | |
|---|---|---|---|
| JP | 07-000673 | U | 1/1995 |
| JP | 10-156755 | A | 6/1998 |
| JP | 2001-260040 | A | 9/2001 |
| JP | 2003-200358 | A | 7/2003 |
| KR | 20-1993-0017899 | U | 8/1993 |

OTHER PUBLICATIONS

Raymond P. Fredrich, Nail Pullers, Authorhouse: Bloomington, IN, pp. 1-118, 2006. File is split into two pieces to facilitate the EFS filing of the reference.

* cited by examiner

FASTENER EXTRACTION TOOL

REFERENCE TO RELATED APPLICATIONS

This application claims an invention that was disclosed in one or more of the following provisional applications: U.S. Provisional Application No. 61/154,548, filed Feb. 23, 2009, entitled "FASTENER EXTRACTION TOOL" and U.S. Provisional Application No. 61/218,199, filed Jun. 18, 2009, entitled "FASTENER EXTRACTION TOOL". The benefit under 35 USC §119(e) of the United States provisional applications is hereby claimed, and the aforementioned applications are hereby incorporated herein by reference.

This is a continuation-in-part patent application of co-pending U.S. application Ser. No. 12/169,095, filed Jul. 8, 2008, entitled "FASTENER EXTRACTION TOOL", which is a continuation-in-part of co-pending U.S. application Ser. No. 11/972,742, filed Jan. 11, 2008, entitled "FASTENER EXTRACTION TOOL", which claims priority to U.S. Provisional Application No. 61/003,834, filed Nov. 20, 2007, entitled "FASTENER EXTRACTION TOOL". The aforementioned applications are hereby incorporated herein by reference.

The subject matter of this application is related to U.S. Pat. No. 7,249,752, entitled "HAND TOOL FOR EXTRACTING A FASTENER FROM A MATERIAL", issued Jul. 31, 2007. The aforementioned patent is hereby incorporated herein by reference.

BACKGROUND OF THE INVENTION

1. Field of the Invention

The invention pertains to the field of hand tools. More particularly, the invention pertains to a hand tool having operable gripping jaws for extracting fasteners embedded in a material.

2. Description of Related Art

Fasteners, such as nails, brads, and staples, are commonly used to fasten objects to workpieces such as wood. A hammer, as is used to drive nails and brads, typically includes a claw for removing nails. Unfortunately, the claws of hammers do not grip fasteners with small heads such as finish nails and brads well. Furthermore, the heads of nails and brads are typically driven slightly below the surface of the fastened workpiece so the fasteners are less visible. In order to extract such an embedded fastener using the claws of a hammer, the fastener head must first be raised above the surface of the workpiece in which the fastener is embedded. Furthermore, powered nail guns are increasingly replacing hammers, and often drive nail heads below the workpiece surface, even for common nails. Nail guns typically have no provision for removing nails. Similarly, the use of staples in place of nails is increasing, and stapling tools also lack a means for removing fasteners.

Because of the above considerations there is a need for a dedicated tool to remove embedded fasteners. In addition to the claw found on common hammers, tools have been developed specifically for the purpose of removing fasteners, such as nails, brads, and staples, from workpieces.

A different type of nail extraction tool is typified by the apparatus disclosed in U.S. Pat. No. 143,496 to Capewell. This tool is oriented vertically above the fastener to be removed, and has hinged pincer-like jaws that can be driven under the fastener by means of a slide hammer integral to the vertical handle of the tool. Typically, one of the jaws has an extension that acts as a fulcrum for levering a gripped fastener from the workpiece. This class of tool is best suited to rough work where the appearance of the material is unimportant, such as the disassembly of crates or framing, since the pincers tend to cause significant damage to the surface of the workpiece around the fastener head, and the small area of the fulcrum generally causes damage to the surface against which it is applied. A related class of tool is disclosed in U.S. Pat. No. 6,733,001 to Wagner. The Wagner tool, like the Capewell tool and all other prior art fastener extraction tools with jaws, is oriented vertically above a fastener, in contrast to a tool of the present invention, which is preferably oriented horizontally with respect to the fastener. The Wagner tool includes moveable jaws for grasping the fastener and a fulcrum surface contiguous with one jaw. To apply the Wagner tool, the fastener must be partially emergent from the workpiece since the tool provides no means for digging under a fastener head that is flush with or embedded below the surface of the workpiece. This represents a significant inconvenience, since in many instances a user is forced to apply two separate tools to complete the job: one tool to pry the fastener head proud of the surface, and then the Wagner tool to complete the removal. This represents a significant inconvenience and inevitably slows the progress of the work at hand.

It would be beneficial to have a hand tool better adapted to extract a fastener from a workpiece. Such a hand tool should be capable of both easily accessing a fastener head flush with or below a surface and effectively prying the entire fastener from the workpiece without causing significant damage to the surface.

SUMMARY OF THE INVENTION

A hand tool is disclosed for extracting a fastener from a material. The hand tool has a head with two pivotally joined halves including at least one pair of gripping jaws for gripping a fastener from a horizontal orientation. The tool head preferably includes tips that may be used to dig beneath a fastener head that is flush with or set below a surface. The tool includes a pair of handles operable to close the gripping jaws. The handles are preferably offset above the plane of the tool head such that they operate as a lever in cooperation with a fulcrum on the bottom of the tool head to extract the fastener.

Other features and advantages of the present invention will become apparent from the following more detailed description, taken in conjunction with the accompanying drawings, which illustrate, by way of example, the principles of the invention.

DETAILED DESCRIPTION OF THE INVENTION

A tool closely related to the present invention is disclosed in commonly-owned U.S. Pat. No. 7,249,752, issued Jul. 31, 2007 to Foley, the disclosure of which is hereby incorporated herein by reference.

Figure 1A:
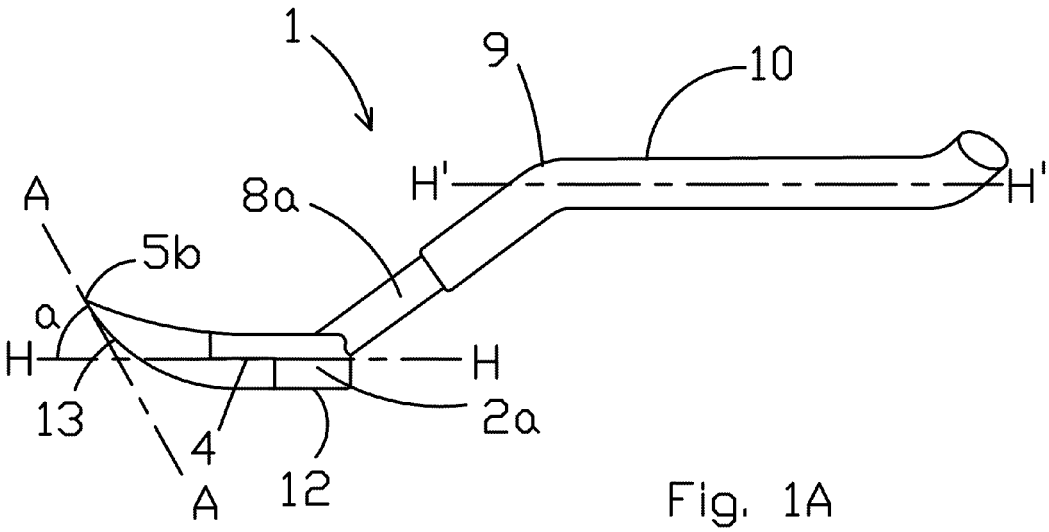
FIG. 1A shows a side view of a fastener extraction tool in an open position in an embodiment of the present invention.

The following terms as used herein are defined relative to the tool or the workpiece. With reference to the tool, as shown in FIG. 1A, forward is defined as toward the left, rearward is defined as toward the right, upward is defined as toward the top of the page, and downward is defined as toward the bottom of the page. Also with reference to the tool, as shown in FIG. 1A, horizontal is a direction or plane perpendicular to the axis of the pivot 3, such as plane H-H, and vertical is a direction or plane perpendicular to the horizontal plane. With reference to a workpiece, upward is defined as away from the surface of the workpiece where the fastener is lodged and downward is defined as toward the surface of the workpiece where the fastener is lodged.

In contrast to prior art fastener extraction tools with jaws which grip a fastener from above, or from a vertical orientation, a fastener extraction tool of the present invention preferably operates by gripping the fastener with jaws from the side, or from a horizontal orientation. A horizontal orientation of the jaws allows a tool of the present invention to grip or re-grip the fastener no matter what the length of the fastener or the depth the fastener is embedded into a workpiece. A fastener extraction tool of the present invention also preferably grips the fastener at the extraction point where the fastener goes into the workpiece in order to provide a maximum amount of extraction of the fastener for a single pull before re-gripping the fastener to continue the extraction, if necessary. The horizontal orientation of the jaws also allows the tool to extract using the wide base of the tool head as the fulcrum, thereby spreading out the leverage force and minimizing damage to the workpiece during extraction.

FIGS. 1A through 1F depict a first embodiment of a fastener extraction tool 1 of the present invention. The fastener extraction tool 1 includes a tool head 2 which has two halves 2*a*, 2*b*. The halves 2*a*, 2*b* overlap in a central region where they are pivotally joined by a pivot 3. As can be seen in FIG. 1A, the overlap of the halves 2*a*, 2*b* at an interface 4 defines a substantially horizontal rotation plane H-H. Moving the halves 2*a*, 2*b* about the pivot 3 causes the tool head halves 2*a*, 2*b* to rotate relative to one another in the plane H-H shown in FIGS. 1A and 1C. Each half 2*a*, 2*b* of the tool head 2 has a portion extending forward of the pivot 3. The portions of the tool head halves 2*a*, 2*b* that are forward of the pivot 3 are tapered in at least one dimension such that the forward tips 5*a*, 5*b* of the tool head form a sharp implement that may be used to dig beneath the head of a fastener to extract it from the surface of a workpiece in which it is embedded.

The tool head 2 includes one or more pairs of gripping jaws for grasping and pulling fasteners. These gripping jaws are preferably formed from inward facing surfaces of tool head halves 2*a*, 2*b*. In the specific embodiment of the tool depicted in FIGS. 1A through 1F, there are two such pairs of jaws. A first pair of jaws 6 is located forward of the pivot 3 and includes two faces 6*a*, 6*b*. A second pair of jaws 7 is located rearward of the pivot 3 and includes two faces 7*a*, 7*b*. When the handles of the tool are brought together, the faces 6*a*, 6*b* and 7*a*, 7*b* of each pair of jaws come together along a longitudinal axis extending from the center front of the tool head 2 through the pivot 3 to the center rear of the tool head 2. In alternate embodiments, the fastener extraction tool may include only the forward pair of gripping jaws, only the rearward pair of gripping jaws, or more than two sets of gripping jaws.

The gripping jaws preferably include opposing gripping surfaces, which may be of any texture or material that allows the jaws to grip a fastener without slipping when held together by the user. Preferably, one or both of the pairs of jaws 6, 7 include a textured surface to better grasp a fastener. In the embodiment depicted in FIGS. 1C through 1F, this textured surface consists of grooves 11 oriented longitudinally along both faces of the pairs of jaws 6, 7. The grooves may have any suitable profile but are particularly effective when triangular in cross section as shown in FIGS. 1C through 1F. The grooves on each jaw may be arranged to mesh or to interfere when the jaws are closed.

The gripping jaws 6, 7 of the fastener extraction tool 1 do not primarily include cutting surfaces, such as those found in nippers and wire cutters, which may be of superficially similar appearance. Such cutting surfaces interfere with the goal of extracting a fastener. For instance, if one attempts to grip a fastener shaft with such cutting jaws and applies a force sufficient to facilitate its extraction, the blades of the tool simply cut through the fastener before it is fully extracted. The jaws of the present tool preferably have a sufficiently broad surface to prevent this undesirable cutting through of a fastener. Nonetheless, in alternate embodiments, to increase the possible uses of the tool, a secondary pair of cutting jaws may be included, or a portion of one or more pair of jaws may be provided with a sharp portion for cutting.

The fastener extraction tool 1 has two handles 8*a*, 8*b* extending rearward from the tool head 2, each handle extending from one half of the tool head 2*a*, 2*b* respectively. Moving the handles 8*a* and 8*b* together or apart causes the halves 2*a*, 2*b* of the tool head 2 to rotate about the pivot 3 and the pairs of gripping jaws 6, 7 to close and open. Preferably, at least a portion of the handles 8*a*, 8*b* is offset above the tool head. This portion includes a gripping portion for the user to apply a gripping pressure to the handles, which is transferred to the jaws for gripping the fastener. This offset allows leverage to be applied by exerting a downward force on the handles. In some embodiments, the gripping portions of the handles are only slightly offset above the plane H-H. In one embodiment, the gripping portions are offset by less than one inch. As shown in FIG. 1A, the handles are preferably offset in a plane H'-H', which is substantially parallel and located significantly above the plane H-H of the pivot. In some embodiments, the gripping portions of the handle are curved or angled so that they are not parallel. In some embodiments, the gripping portions are shaped to the contour of a hand gripping the handles. The handles may optionally include a surface coating 10 as shown in the figures. This surface coating is preferably a resilient material such as polymeric material that provides a surer grip for the user and makes the tool more comfortable to use. In addition, the handles are preferably sized and spaced to allow a comfortable grip of the tool by a user. In the depicted embodiments, the tool is configured for a single-handed grip, although in alternate embodiments of the present invention, such as those intended for heavier work, the handles may be sized and spaced for comfortable two-handed operation.

Figure 1B:
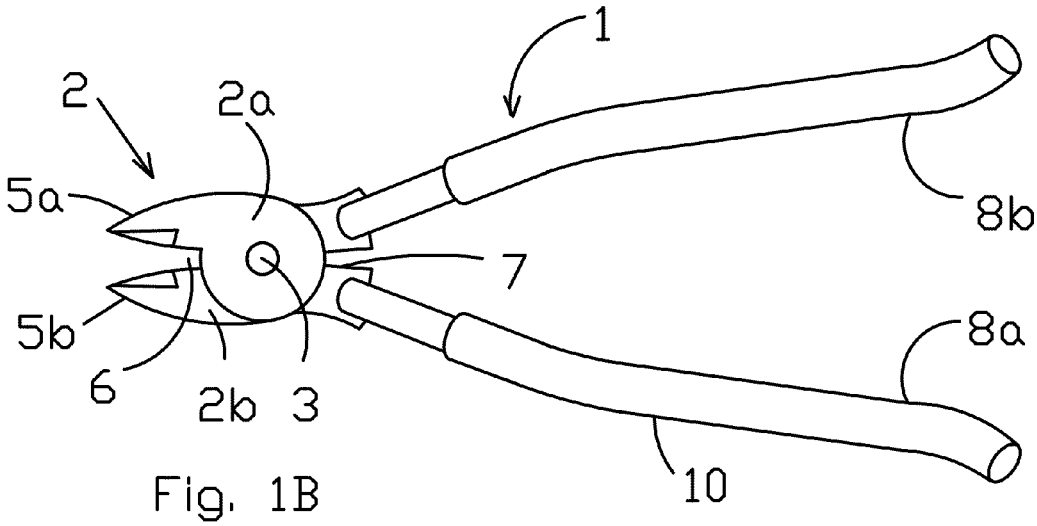
FIG. 1B shows a top view of the embodiment of FIG. 1A.
Figure 1C:
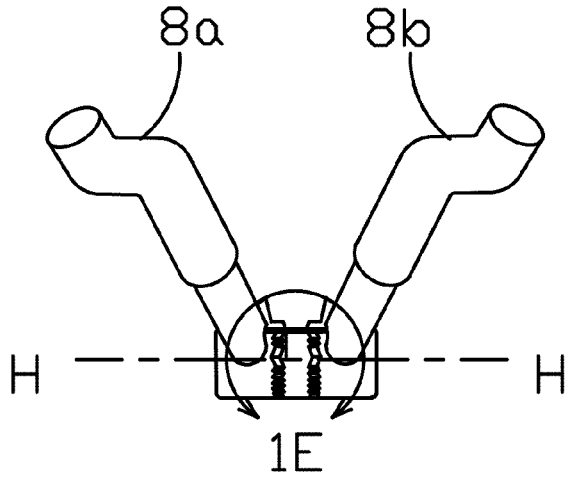
FIG. 1C shows a rear view of the embodiment of FIG. 1A.
Figure 1D:
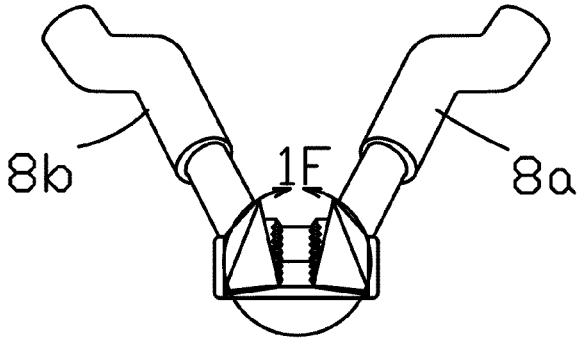
FIG. 1D shows a front view of the embodiment of FIG. 1A.
Figure 1E:
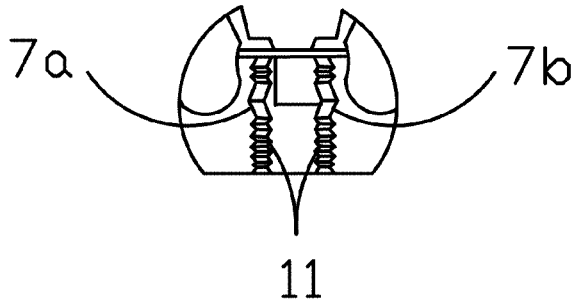
FIG. 1E shows a detailed view of the circle region 1E of FIG. 1C.
Figure 1F:
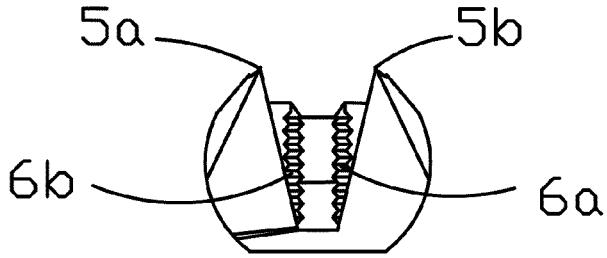
FIG. 1F shows a detailed view of the circle region 1F of FIG. 1D.

In the specific embodiment depicted in FIGS. 1A and 1B, the handles 8*a*, 8*b* extend rearward from the tool head 2 at an upward angle to a bend 9 beyond which the handles extend rearward in a direction substantially parallel to the plane H-H. It is to be understood that other shapes and arrangements of the handles may be used within the spirit of the present invention. The handles may extend upward for their entire length or may be curved or otherwise differently shaped than the depicted embodiments.

Figure 2:
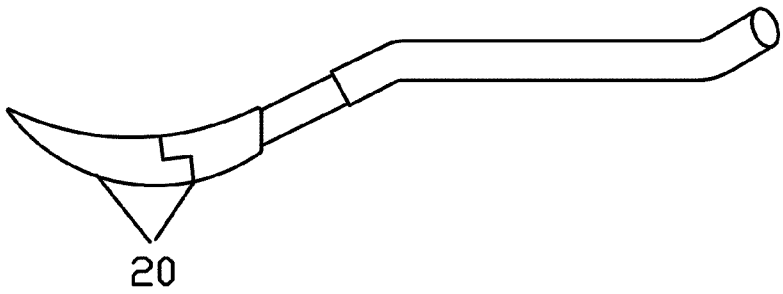
FIG. 2 shows a fastener extraction tool with a spoon-shaped profile in an embodiment of the present invention.

Preferably, a fastener extraction tool of the present invention has a longitudinally curved profile sloping upward toward either the front tip or the back end of the tool head on at least a portion of the bottom surface of the tool. This longitudinal curve aids in applying leverage to extract a fastener. FIG. 1A shows a plane A-A tangent to the underside of the forward jaws near the tip 5*b*. This plane A-A preferably forms an angle a with plane H-H, where angle a is preferably at least 45°. When the curved portion of the tool head bottom is used as the fulcrum to apply this leverage, it reduces the chance that the surface from which the fastener is being removed becomes damaged, since in such an arrangement, the fulcrum point of the tool moves in relation to the surface of the workpiece as the tool handles are moved upward or downward. This feature lowers the chance that a damaging force is applied at a particular point on the surface. The curve on the bottom of the tool head may encompass the entire length of the tool head, or it may extend for only a portion of the length. In the embodiment depicted in FIG. 1A, the tool head 2 includes a flat portion 12 rearward of the pivot, and only the front portion 13 of the profile is longitudinally curved. In the embodiment depicted in FIG. 2, the bottom 20 of the tool head is curved along its entire length, creating a spoon-like longitudinal profile. It is to be understood that the direction and extent of the curvature on the bottom of the tool head may be modified without departing from the spirit of the present invention.

Figure 3:
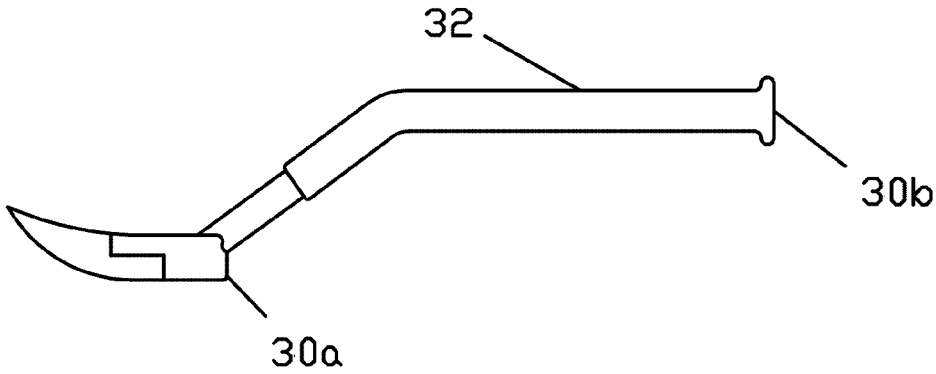
FIG. 3 shows a fastener extraction tool with striking surfaces of a hammer tap in an embodiment of the present invention.

Another preferred feature of a fastener extraction tool of the present invention is at least one striking surface of a hammer tap designed to receive a blow from a hammer or similar tool. This feature allows a user to apply additional force to the tool to aid in extracting a fastener. In the embodiment shown in FIG. 3, a striking surface 30*a* is formed at the back of the tool head and another striking surface 30*b* is formed at the free end of one or both of the handles 32. The striking surface 30*a* at the back of the tool head is preferred in that it allows the user to drive the tool with a hammer or other striking tool with one hand in the direction of the forward tips while holding the handles with the other hand. The striking surface of the hammer tap may also be formed on a back surface of an extension of the tool head. The extension may extend upward or to a side of the tool head. With these arrangements, a hammer blow effectively applies the force necessary to drive the sharp tips of the tool head into a material, thereby allowing them to dig beneath and extract the head of an embedded fastener. The striking surface is particularly effective in combination with the claw-shaped portion discussed below in digging beneath a fastener head. The striking surface of the hammer tap may have a bull's eye or similar pattern to aid the user in aiming. The striking surface may also have a non-metallic coating to reduce the noise of a metal hammer strike and to reduce sliding of the hammer in a glancing blow to the striking surface.

Figure 4:
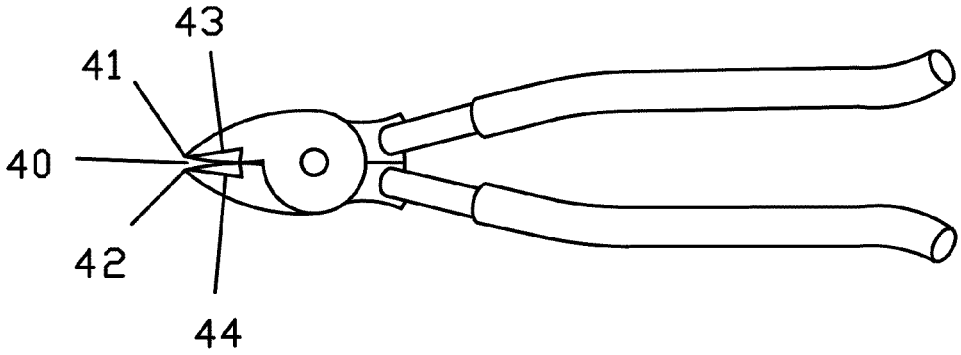
FIG. 4 shows a fastener extraction tool with splayed tips in an embodiment of the present invention.

A number of additional features may be included on a fastener extraction tool of the present invention. Each of these features may be used in combination with any of the other features. The tool may include a claw-shaped portion at the forward end of the tool head. FIG. 4 illustrates a particular embodiment of this feature. The forward-most portion of each jaw is splayed outward slightly such that that the forward-portions of the jaws does not meet 40 when the gripping portion is closed as shown in FIG. 4. This splayed arrangement of the jaw tips 41, 42, in combination with the tapered shape of the forward jaws creates a feature similar to the claw on a common hammer or a tack puller. This claw-like feature allows a user to access and pry an embedded fastener upward so that it may be effectively grasped and removed by the gripping jaws. Preferably, the splayed portion of each jaw also includes an inward bevel 43, 44, such that the inward facing surface of the splayed portion has a narrow edge that may be slid under a fastener head. As shown in FIG. 4, this bevel may be inclined forward so that the edge narrows toward the tip of the tool, this arrangement tending to raise the fastener head as the claw is worked forward underneath it. Additionally, the splayed portions preferably taper to a shape that facilitates digging into wood or a similar material. In the embodiment of the tool depicted in FIG. 4, the tips of the claw taper to sharp points that readily penetrate wood or similar materials. In alternate embodiments, the tips may have other shapes, including, but not limited to, chisel-like ends, to perform a similar function.

Figure 5:
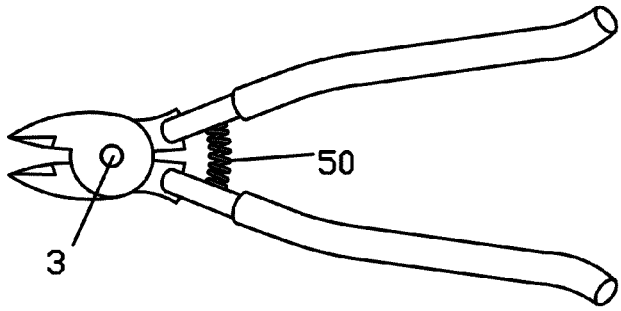
FIG. 5 shows a fastener extraction tool with a spring system in an embodiment of the present invention.

A second feature that may be included on a fastener extraction tool of the present invention is a biasing element that biases the jaws to an open position. As shown in FIG. 5, a spring system 50 is disposed between the handles rearward of the pivot 3. The spring may be mounted on inwardly facing extensions or holes of the handles. In some embodiments the spring is reversibly removable from the extensions or holes such that the user has the option to use the tool with or without the spring bias depending on the particular task at hand. Many other arrangements are known in the art for biasing the handles of pliers and similar tools. These arrangements include various types of springs disposed in a variety of ways. It is to be understood that any such mechanism may be adapted to the present tool without departing from the spirit of the present invention.

Figure 6:
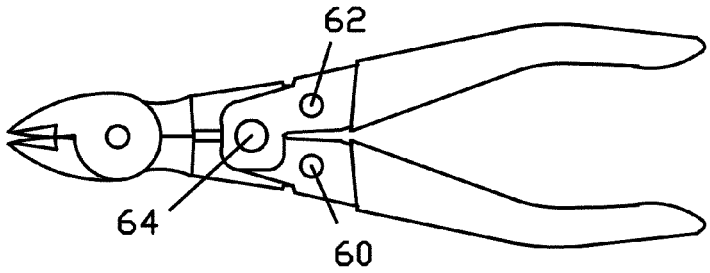
FIG. 6 shows a fastener extraction tool with compound pivots in an embodiment of the present invention.

A third feature that may be included on a fastener extraction tool of the present invention is a compound leverage action between the tool head and the handles. Hand tools designed to apply heavy gripping or cutting forces often include a multi-part pivot assembly between their handles and the tool head, which multiplies a force applied to the handles of the tool. The embodiment of the present invention depicted in FIG. 6 shows one such compound leverage mechanism. In this embodiment, each half of the tool head is pivotally linked to one of the handles at a pivot 60, 62. The handles are pivotally linked to each other at a third pivot point 64, located forward of the first two pivots 60, 62. With the compound handles, moving the handles relative to each other through a given angle results in a smaller angular rotation of the tool head halves than with simple handles, but the force transmitted is correspondingly increased. Other compound leverage arrangements for hand tools such as sheet metal shears, bolt cutters, locking pliers, and the like are well known in the art, and it is to be understood that any such mechanism may be incorporated into the present invention.

Figure 7:
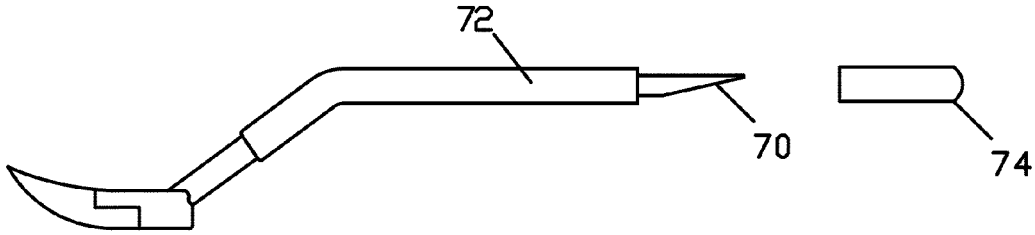
FIG. 7 shows a fastener extraction tool with a chisel handle in an embodiment of the present invention.

A fourth feature that may be included on a fastener extraction tool of the present invention is a flat chisel-type end to at least one of the handles. FIG. 7 shows a chisel bar 70 at a terminal end of a handle 72. The chisel bar 70 is preferably formed integral with the handle 70. When the user is using the head of the tool, the chisel bar 70 is preferably covered by a cap 74 to prevent injury to the user. The cap may be made of the same material as the handle grips or of a harder material to prevent damage to the cap by the chisel bar. Chisel bars 70 may be located either on both handles or on just one handle and are preferably used to pry boards or other large building materials apart.

Figure 8A:
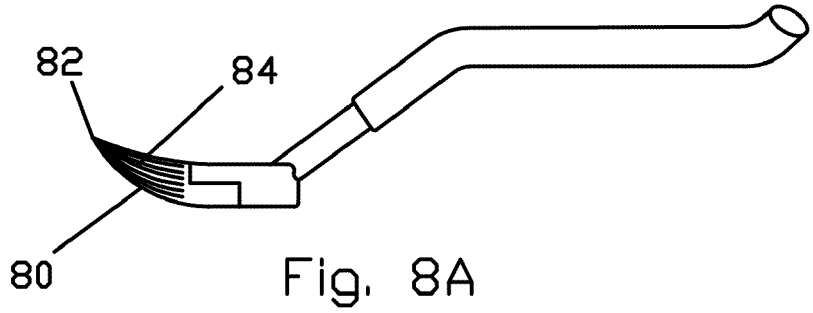
FIG. 8A shows a cut away side view of a fastener extraction tool with a gripping surface extending to the tip in an embodiment of the present invention.
Figure 8B:
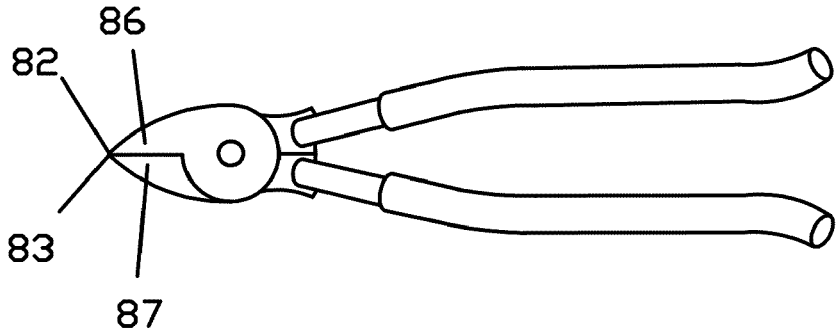
FIG. 8B shows a top view of the embodiment of FIG. 8A.

In an alternate embodiment of the present invention, FIG. 8A shows the gripping surfaces 80 of the forward jaws extending all the way to the tips 82 of the forward jaws. FIG. 8A is a cut-away view showing only half of the tool head. Although the gripping surfaces 80 are shown as having teeth formed of horizontally-oriented grooves 84, any surface topography or coating which provides enough friction or surface roughness to grab a fastener without slipping may be used within the spirit of the present invention. In this embodiment, as shown in FIG. 8B, the tips 82, 83 preferably meet when the jaws are closed, and the tops 86, 87 of the jaws are preferably substantially flat.

A fastener extraction tool of the present invention may be made from a variety of materials as long as they have the required strength and malleability to be produced in the shapes required. Preferably, the tool is made of steel or a similar high strength material. If the tool is intended for service where corrosion is a concern, the tool may be manufactured of corrosion-resistant materials such as stainless steel or bronze. The surfaces of the tool may optionally be treated by plating or by applying decorative or corrosion-resistant coatings or finishes typical of hand tools. The metal from which the tool is manufactured may be hardened or otherwise treated to ensure that the parts have the necessary strength and durability to perform their functions.

A fastener extraction tool of the present invention preferably provides a user with several options to remove fasteners:

the best mode of using the tool depends on the type of fastener to be removed, the workpiece in which the fastener is embedded, and the location of the fastener relative to surrounding objects. For a fastener that is flush with or embedded below a surface, a typical first step involves accessing the head or shaft. As noted above, the forward portion of the tool head preferably includes a sharp implement to aid in this process. In use, this sharp implement penetrates the surface of the workpiece adjacent to a fastener head, and the tool is then forced toward the fastener to dig beneath the head of the fastener. If the fastener extraction tool includes the striking surface described herein, a hammer may be used to apply additional force to drive the tips of the tool beneath the fastener. The claw-shaped portion at the tip of the forward jaws may also aid in this process, since it eliminates the need for the user to keep the jaws separated to accommodate the shaft of the fastener.

Once the forward tips of the tool head are inserted beneath a fastener head, downward movement of the handles causes movement about a fulcrum point on the bottom of the tool, and an upward force is imparted to the fastener, thereby raising it from the surface of the workpiece. If the fastener is short, this action may be sufficient to completely remove it from the workpiece. In cases where the fastener is longer, an additional step is necessary. To complete the removal of the fastener, the user may reposition the tool and use the gripping jaws of the tool head to firmly grasp the head or shaft of the fastener where it is exposed above the surface of the workpiece. When the forward jaws are used, the handles are forced downward while gripping the fastener to rotate the tool about a fulcrum point on the bottom of the tool head rearward of the forward jaws. This action further raises the fastener from the workpiece. For very long nails, this repositioning may be repeated to complete the extraction. If the fastener extraction tool includes a rear pair of jaws as described above, the fastener may be grasped with these jaws instead, in that case, the handles are moved in an upward direction so that the tool pivots about a fulcrum point forward of the rear jaws. The decision as to which pair of jaws to employ in a particular situation may depend on the type of fastener, the available surfaces against which the fulcrum acts, and the amount of space available in which to operate the tool. An assortment of fastener types may be extracted using the methods above, including, but not limited to, nails, staples, brads, tacks, pins and other similar hardware.

Figure 9:
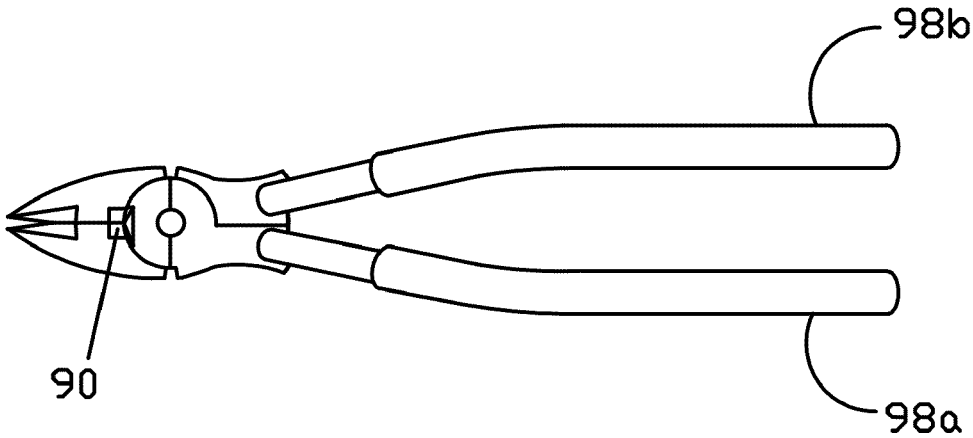
FIG. 9 shows a fastener extraction tool with a straight gripping section and a cutter in an embodiment of the present invention.

To increase the usefulness of the tool, a tool of the present invention may include cutter surfaces to allow the tool to cut wire, nails, or other similar materials. The cutter feature is preferably located in at least a portion of one pair of jaws of the tool. The cutter is preferably located in only a portion of the pair of jaws such that the jaws may be used both for gripping without cutting and for cutting depending on the placement of the object in the jaws. Referring to FIG. 9, in one embodiment, the cutter 90 is located in the forward extending portion of the tool head. In another embodiment of the present invention, the cutter is located in the rearward extending portion of the tool head.

Figure 11:
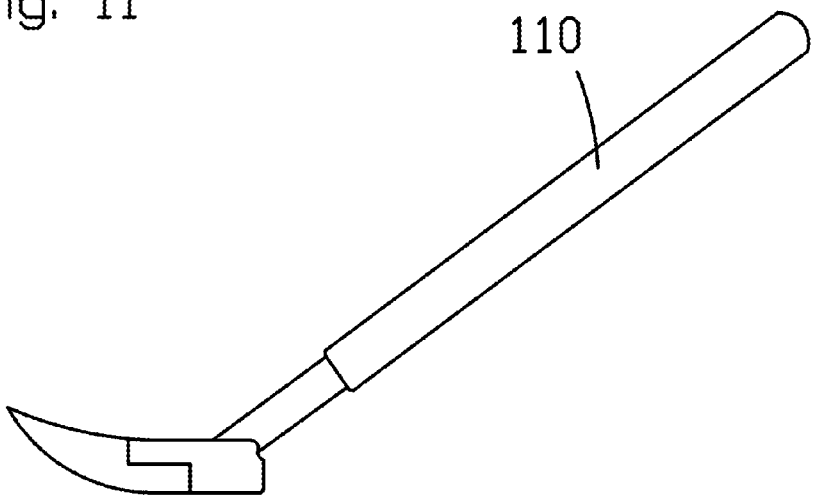
FIG. 11 shows a side view of a fastener extraction tool with a straight handle in an embodiment of the present invention.

FIG. 9 also shows handles 98*a*, 98*b* that are substantially straight along the length of the gripping section as an alternative to the curved ends shown in FIG. 1 through FIG. 8. As a second alternative, FIG. 11 shows handles 110 that extend substantially straight from one end to the other. Each of these handle shapes may be used advantageously depending on the required extraction force and geometry of the fastener/workpiece for the task at hand.

Figure 10A:
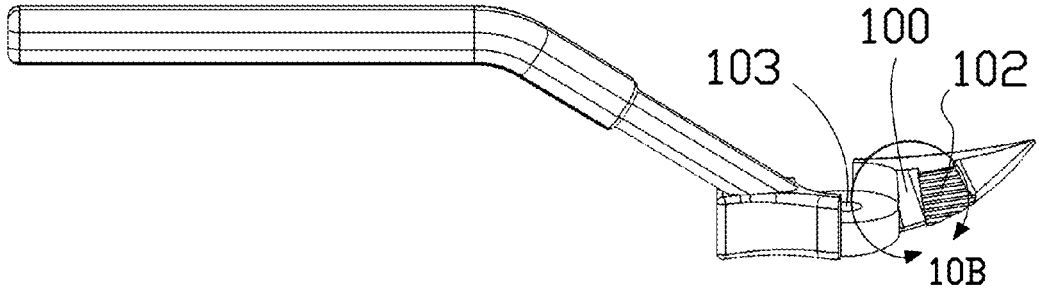
FIG. 10A shows a side view of a half of a fastener extraction tool with a cutter in an embodiment of the present invention.
Figure 10B:
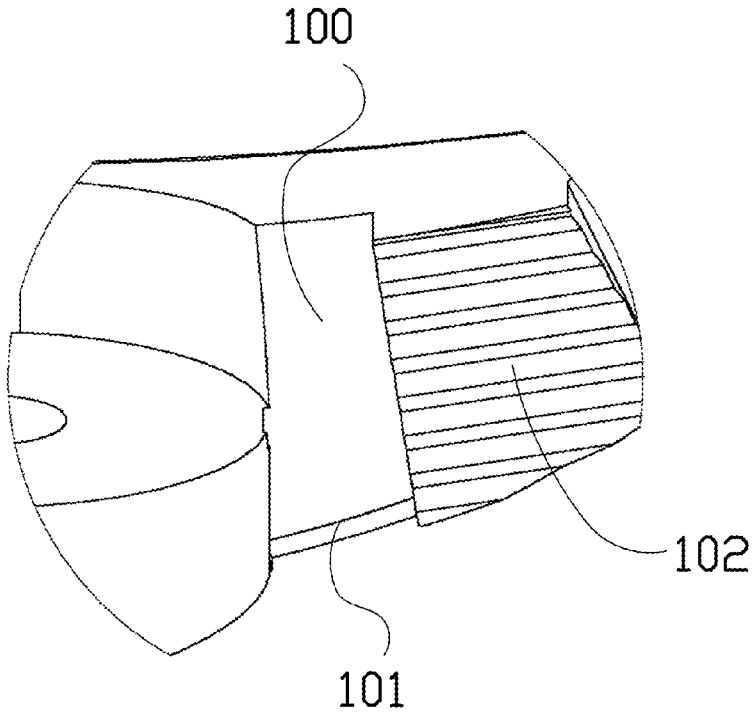
FIG. 10B shows a detailed view of the circle region 10B of FIG. 10A.

FIGS. 10A and 10B show a preferred design of a forward jaw of the present invention including a cutter. The front part of the jaw provides both a gripping feature and a cutting feature. The cutter 100 is located close to the pivot 103 to increase the cutting power of the sharp edge 101. The gripping surface 102 is located farther from the pivot 103 than the cutter to allow a greater lever action for raising a fastener gripped by the gripping surface.

Figure 12:
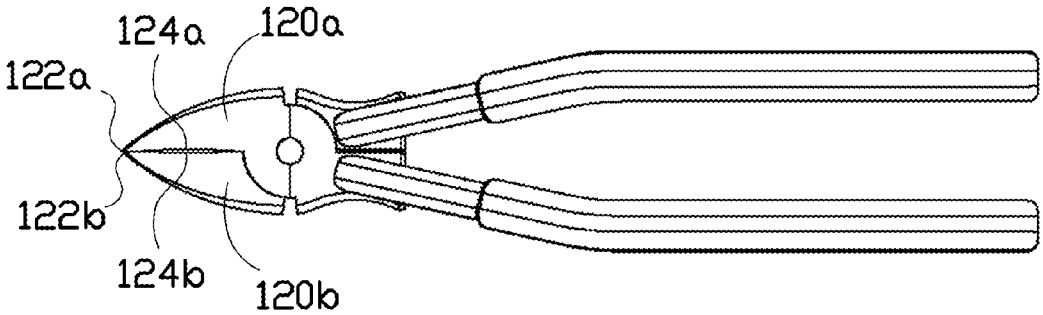
FIG. 12 shows a top view of a fastener extraction tool with concave-shaped forward jaws in a closed position in an embodiment of the present invention.
Figure 13:
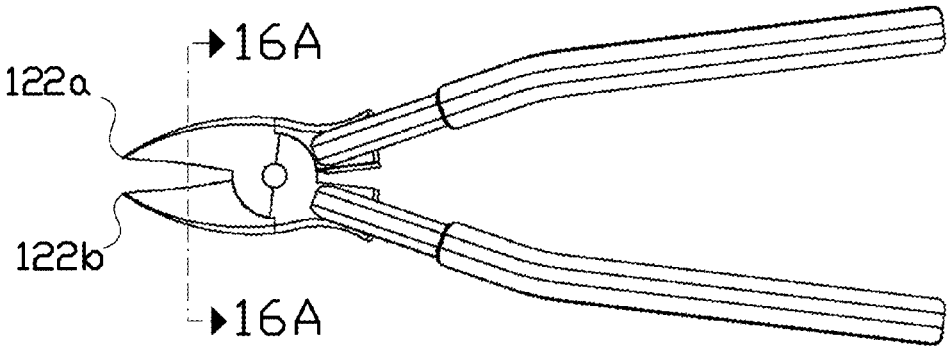
FIG. 13 shows the embodiment of FIG. 12 with the forward jaws in an open position.
Figure 14A:
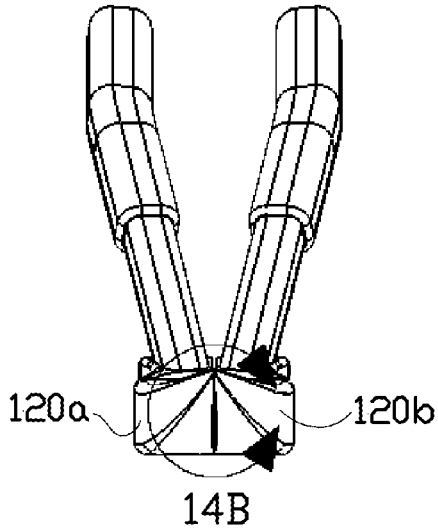
FIG. 14A shows a front view of the embodiment of FIG. 12.
Figure 14B:
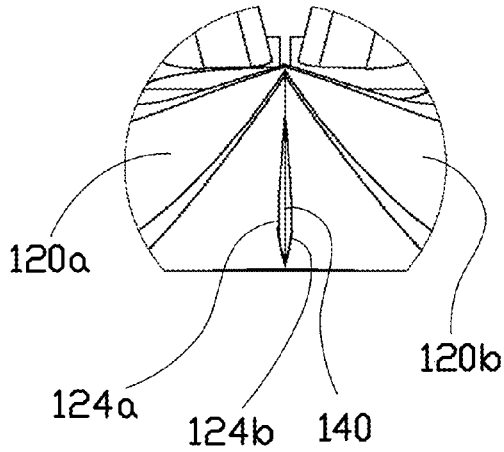
FIG. 14B shows a detailed view of the circle region 14B of FIG. 14A.
Figure 15A:
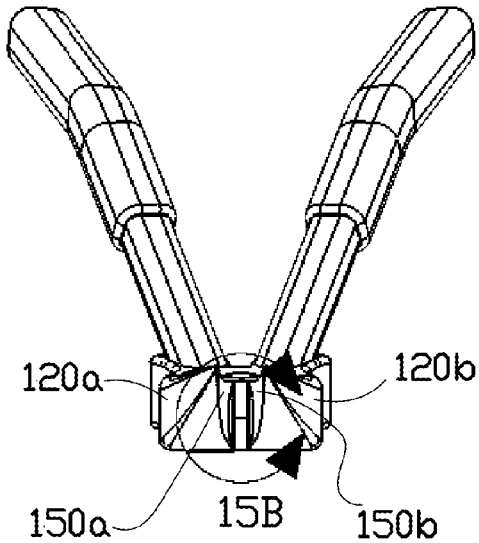
FIG. 15A shows a front view of the embodiment of FIG. 12 in an open position.
Figure 15B:
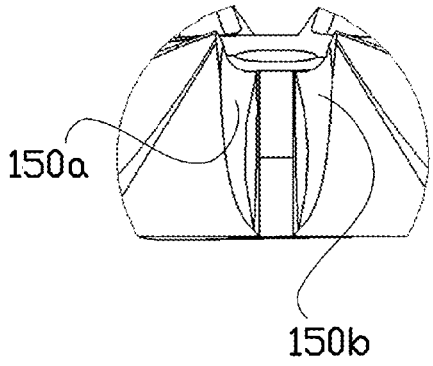
FIG. 15B shows a detailed view of the circle region 15B of FIG. 15A.
Figure 16A:
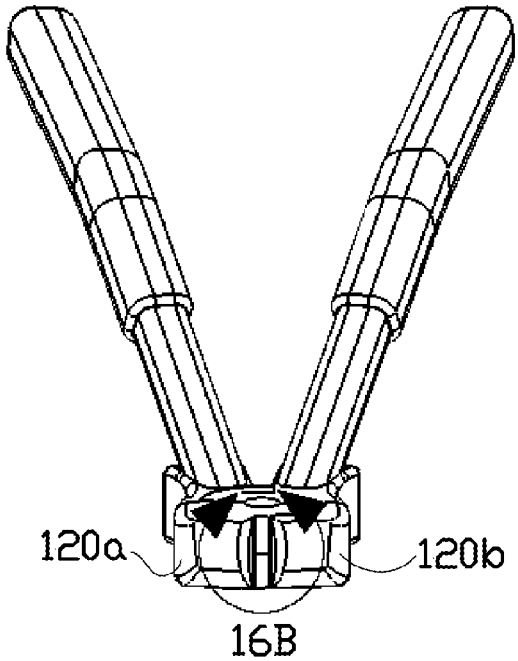
FIG. 16A shows a cross sectional view along line 16A-16A of FIG. 13.
Figure 16B:
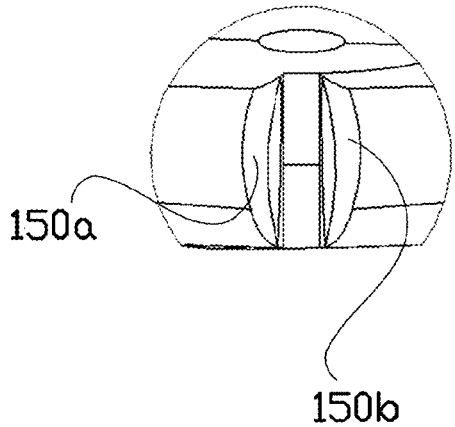
FIG. 16B shows a detailed view of the circle region 16B of FIG. 16A.

FIG. 12 through FIG. 17 show a preferred design of the forward jaws of a fastener extraction tool of the present invention having concavely curved surfaces for gripping without cutting a fastener during extraction. In this embodiment, the forward jaws 120*a*, 120*b* preferably meet at the forward tips 122*a*, 122*b* when the tool is in a closed position, as shown in FIG. 12. The concave shapes 124*a*, 124*b* of the forward jaws allow them to grip while not cutting the fastener, in part due to the gap 140, as best seen in FIG. 14B, that is present between the jaws even when the tool is in a closed position. The forward jaws are preferably designed with a shallow concavity so that they grasp and score or nick but not cut through the fastener being extracted. In this embodiment, the forward jaws 120*a*, 120*b* are preferably concavely curved not only from the back to the forward tip 122*a*, 122*b* but also from the top to the bottom, as best seen in FIG. 15A through FIG. 16B. This concave shape of the gripping surfaces 150*a*, 150*b* helps the forward jaws 120*a*, 120*b* to maintain a grip on a fastener head being held in the forward jaws during extraction of the fastener. In this embodiment, the inward facing gripping surfaces of the forward jaw may have grooves, as shown in FIG. 8A and FIGS. 10A and 10B, or the gripping surfaces may be relatively smooth, as shown in FIGS. 15A and 15B.

Figure 18A:
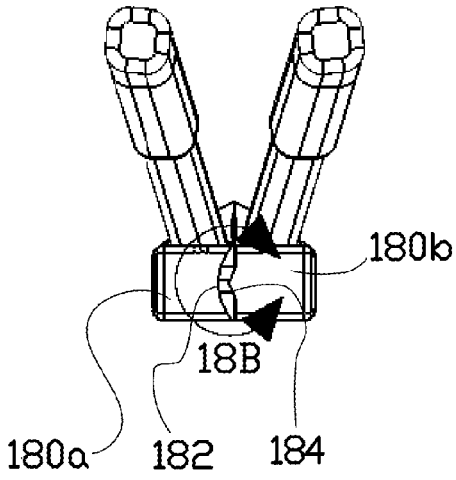
FIG. 18A shows a back view of a fastener extraction tool with rearward jaws having non-complementary surfaces in an embodiment of the present invention.
Figure 18B:
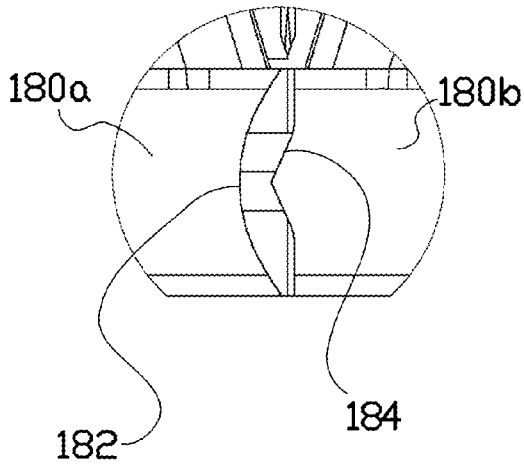
FIG. 18B shows a detailed view of the circle region 17B of FIG. 17A.
Figure 18C:
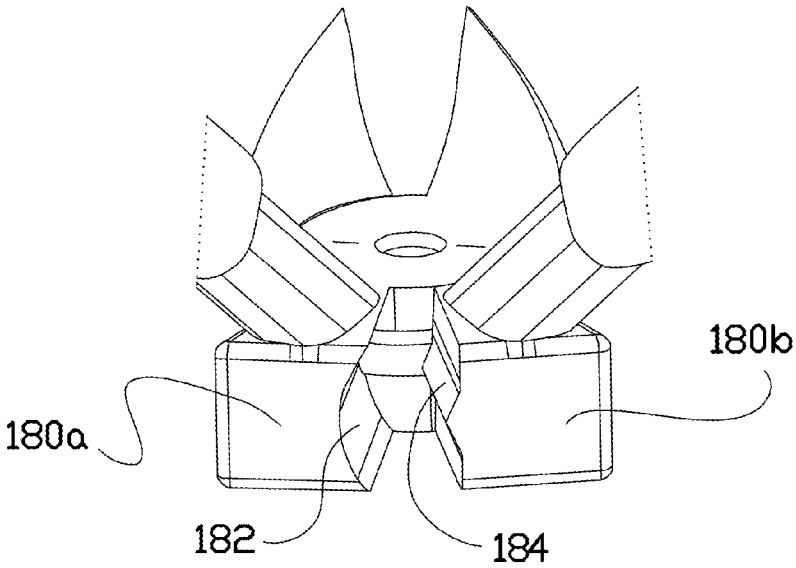
FIG. 18C shows a detailed view of the tool head of FIG. 18A in an open position.

FIG. 18A, FIG. 18B, and FIG. 18C show a preferred design of the rearward jaws of a fastener extraction tool of the present invention having non-complementary surfaces for gripping without cutting a fastener during extraction. Non-complementary surfaces, as used herein, are any surfaces which do not match up when the jaws are fully closed such that at least one gap is formed between the non-complementary surfaces when the jaws are fully closed. The left jaw 180*a* has a gripping surface 182 with a concave curved shape, and the right jaw 180*b* has a gripping surface 184 with multiple angled regions, as best seen in FIG. 18C. The non-complementary surfaces 182, 184 allow gaps between the jaws when the jaws are in a closed position to aid in gripping a fastener without cutting it during extraction. The non-complementary surfaces may be reversed such that the curved surface 182 is on the right jaw 180*b* and the angled surface 184 is on the left jaw 180*a* to provide the same function within the spirit of the present invention. Although FIG. 18A through FIG. 18C show a curved surface and a multi-angled surface, any pair of non-complementary surfaces without edges sufficiently sharp enough to cut a fastener in the rearward jaws may be used within the spirit of the present invention. Other shapes to the non-complementary surfaces include, but are not limited to, any non-complementary curved surfaces, any non-complementary multi-angled surfaces, and any combinations of curved and angled features. Although FIG. 18A through FIG. 18C show each gripping surface having the same contour from front to back, the gripping surfaces may also vary from front to back within the spirit of the present invention.

Figure 19:
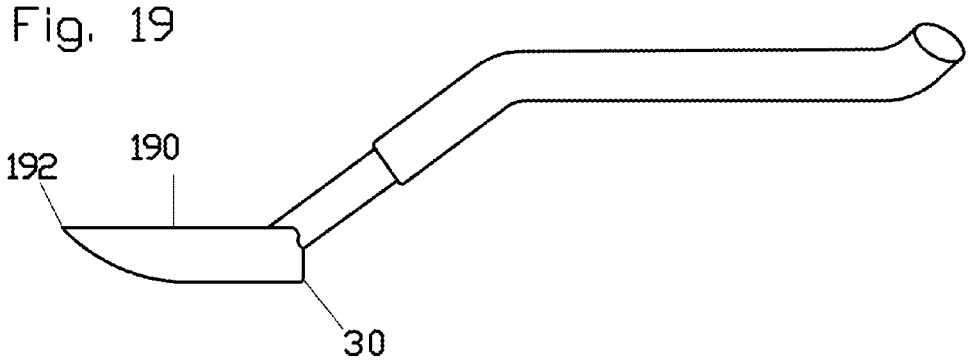
FIG. 19 shows a side view of a fastener extraction tool with flat tool head top surfaces in an embodiment of the present invention.

FIG. 19 shows a fastener extraction tool designed for demolition work in an embodiment of the present invention. In this embodiment, the top surfaces 190 of the tool head are substantially flat from the back of the tool head to the tips rather than curving upward toward the tips. This allows a greater force to be transmitted to the tips 192 when using the striking surface 30 of the hammer tap to drive the tips 192 under a fastener head or into a workpiece.

Figure 20:
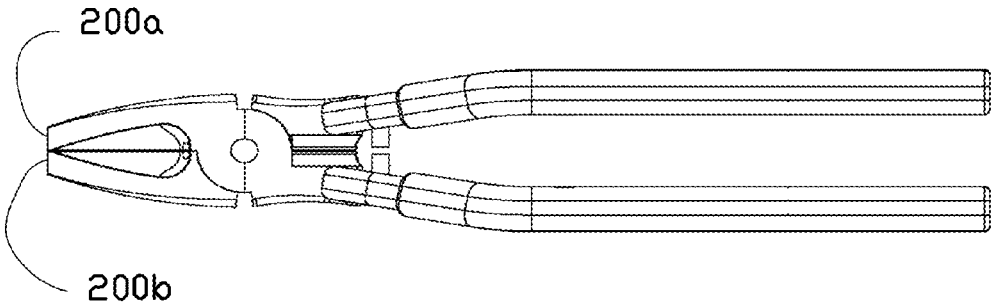
FIG. 20 shows a top view of a fastener extraction tool with cold chisel tips in an embodiment of the present invention.

FIG. 20 shows a fastener extraction tool with flat tips 200*a*, 200*b* on the forward jaws in an embodiment of the present invention. In this embodiment the tips 200*a*, 200*b* are formed to flare out as the tips of a cold chisel or the time of a regular flathead screwdriver. Alternatively, the tips may be formed from a more gradual bevel of the tool head. Alternatively, the cold chisel tips may be angled or include a slight concave or convex curvature. These formations of the tips provide multi-purpose functions to the tool.

Figure 17:
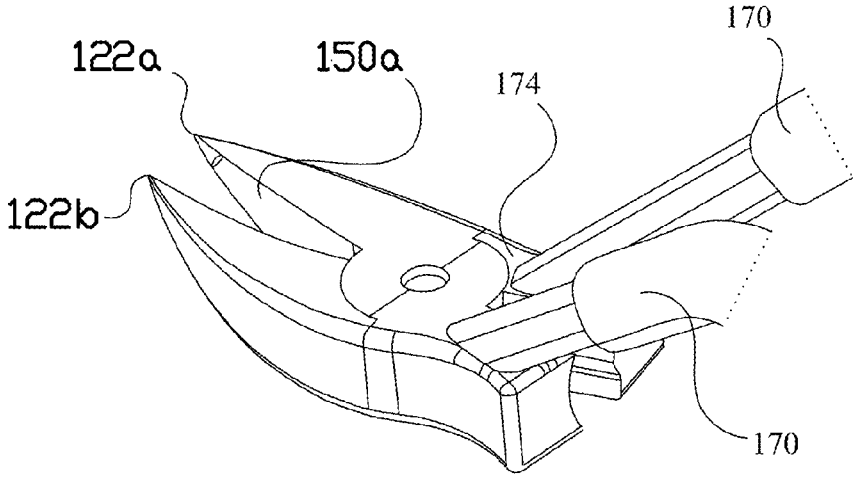
FIG. 17 shows a detailed perspective view of the tool head of the embodiment of FIG. 12 in an open position.
Figure 21:
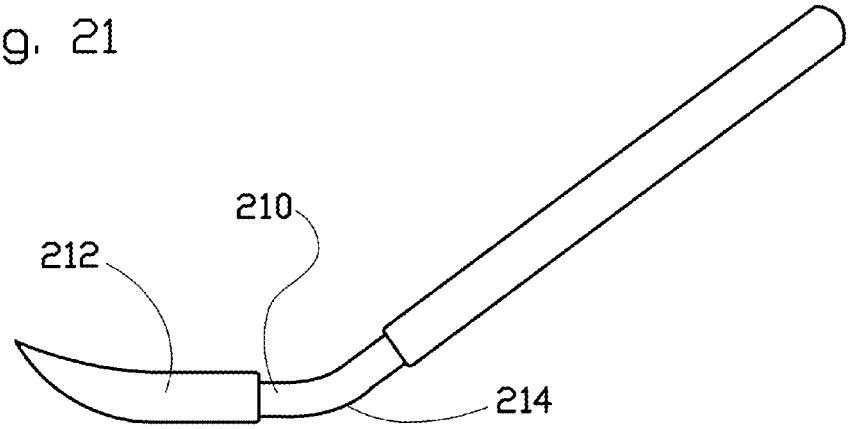
FIG. 21 shows a side view of a fastener extraction tool with handles extending out the back of the tool head in an embodiment of the present invention.
Figure 22:
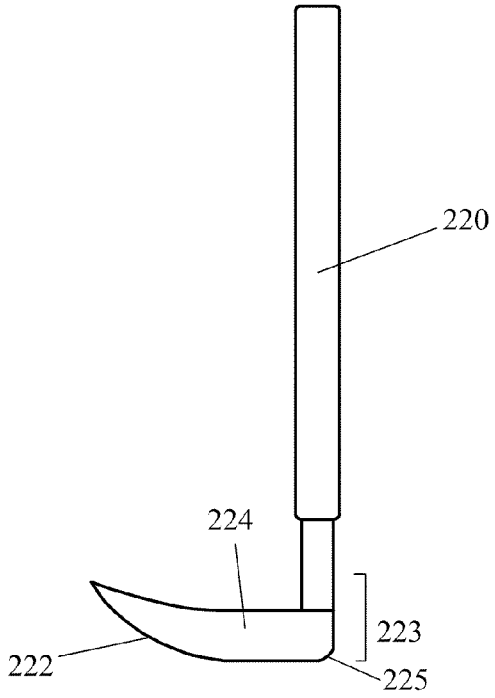
FIG. 22 shows a side view of a fastener extraction tool with handles extending vertically from the top of the tool head in an embodiment of the present invention.
Figure 23:
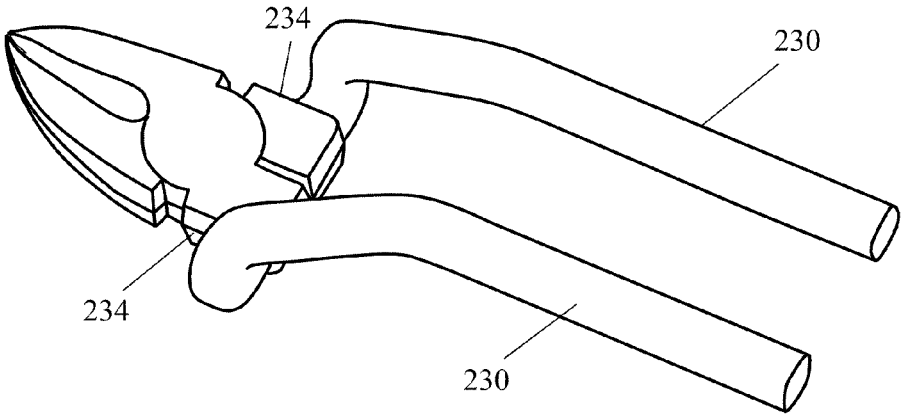
FIG. 23 shows a perspective view of a fastener extraction tool with handles extending out the sides of the tool head in an embodiment of the present invention.
Figure 24:
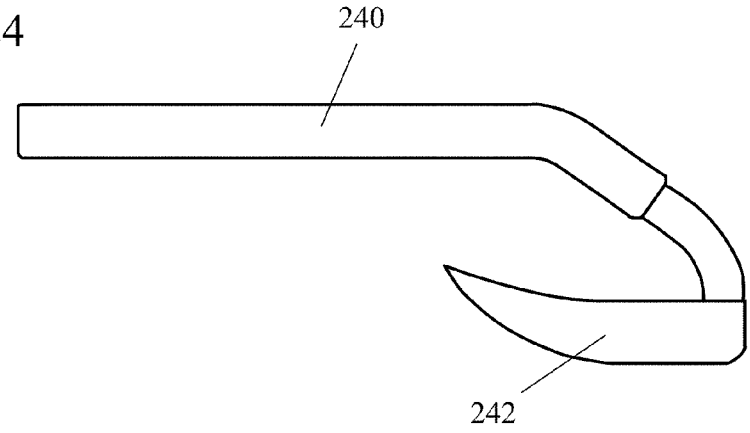
FIG. 24 shows a side view of a fastener extraction tool with handles extending forward in an embodiment of the present invention.

FIG. 21 shows a fastener extraction tool with handles extending out the back of the tool head in an embodiment of the present invention. In this embodiment, the tool is preferably forged with the handles 210 coming horizontally out the back of the tool head 212 and later bent upward 214 as shown in FIG. 21, which lowers the production cost of the tool. The handles 210 may be bent upward at about a 45-degree angle as shown in FIG. 21 or they may be additionally bent to the handle shape as shown in FIG. 1. Alternatively, the fastener extraction tool may be cast with the handles 210 coming out the back of the tool head 212 and extending upward as shown in FIG. 21 within the spirit of the present invention. Alternatively, the handles 170 may extend from top surfaces 174 of the tool head, as shown in FIG. 17, before extending rearward. Alternatively, the handles 220 may extend substantially vertically upward such that the gripping portions of the handles are substantially perpendicular to the pivot plane of the tool head 224, as shown in FIG. 22. Alternatively, the handles 230 may extend from the outwardly facing side surfaces 234 of the tool head, as shown in FIG. 23, before extending rearward. Alternatively, the handles 240 may curl around and extend forward of the tool head 242, as shown in FIG. 24.

Figure 25:
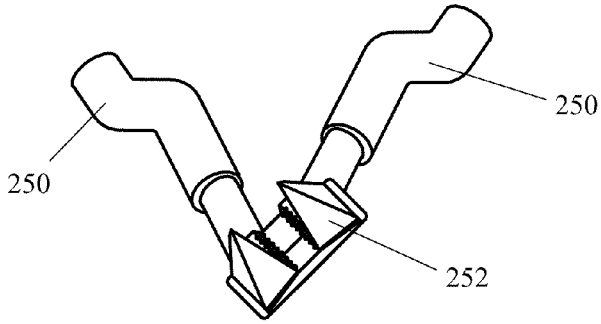
FIG. 25 shows a front view of a fastener extraction tool with the tool head twisted with respect to the handles in an embodiment of the present invention.
Figure 26:
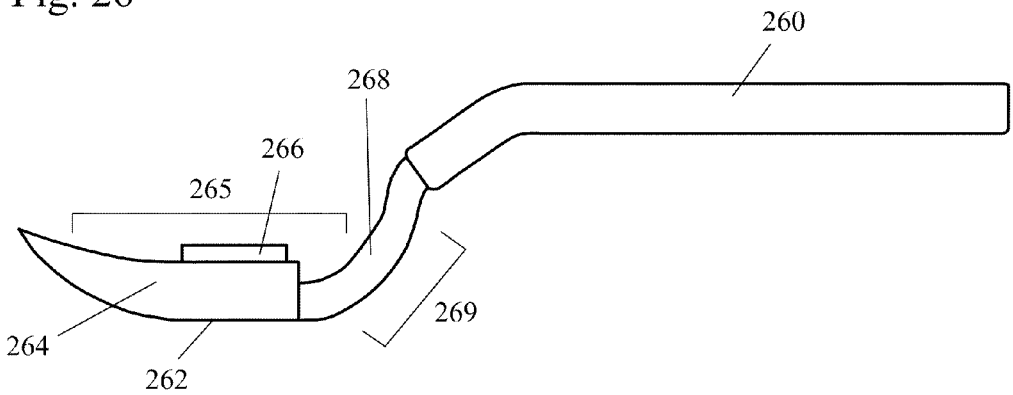
FIG. 26 shows a side view of a fastener extraction tool with handles extending out the back of the tool head in an embodiment of the present invention.
Figure 27:
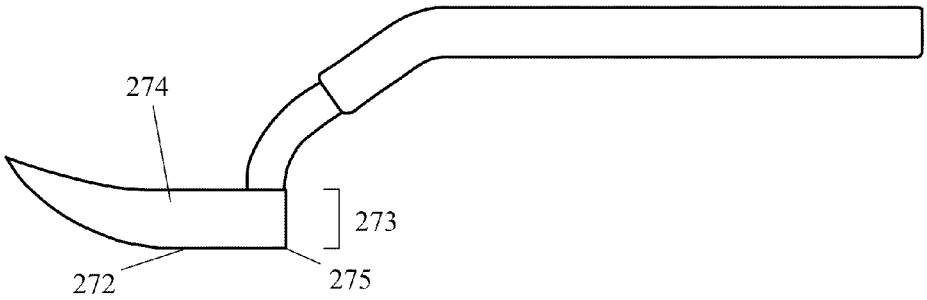
FIG. 27 shows a side view of a fastener extraction tool with a sharp corner and the bottom back of the tool head in an embodiment of the present invention.
Figure 28:
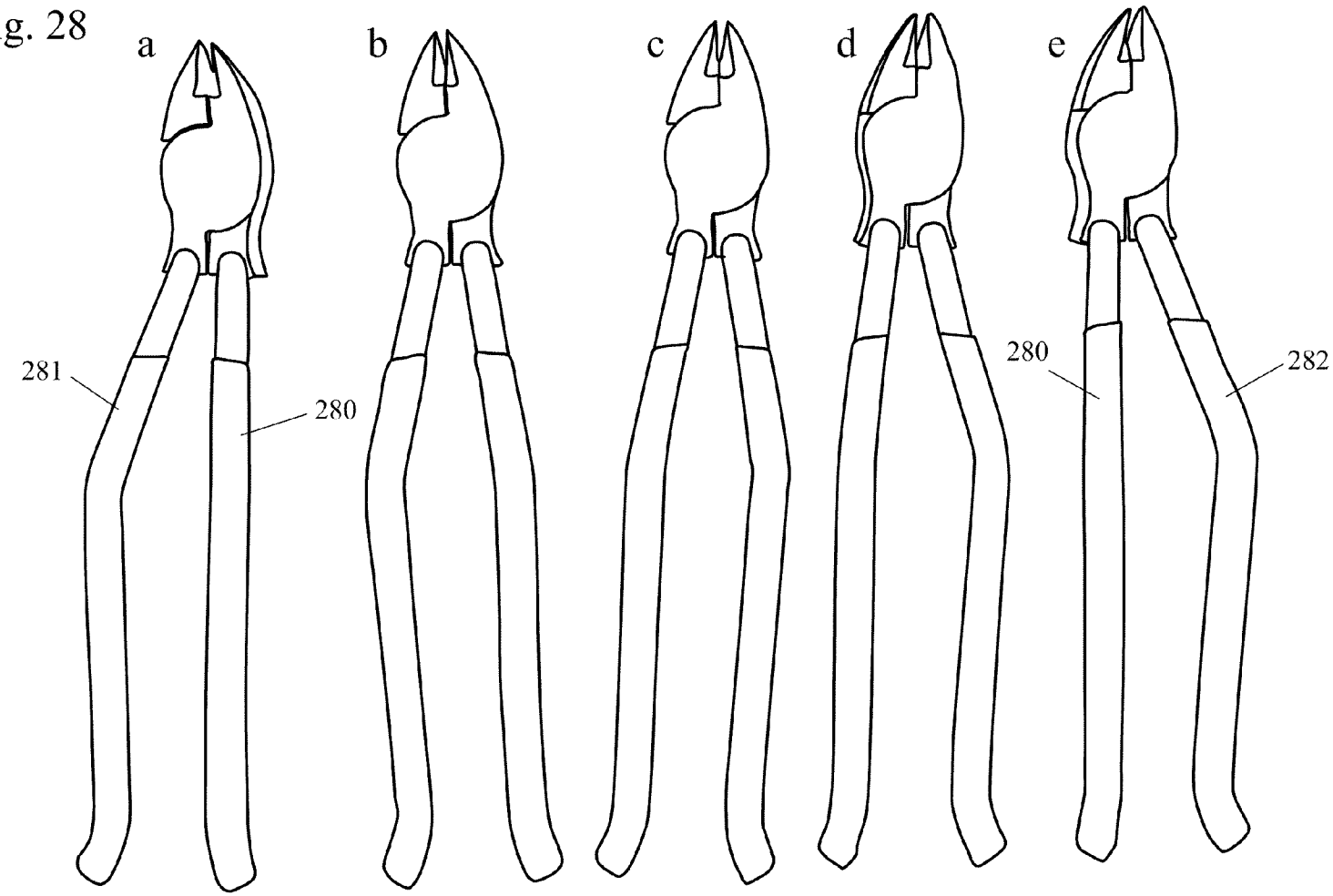
FIGS. 28*a-e* show a top view of fastener extraction tools with handles having varying angles in embodiments of the present invention.

FIG. 25 shows the tool head 252 rotated along its horizontal axis with respect to the handles such that, when the tool head is horizontal, the handles 250 extend at an angle from vertical, instead of the handles extending symmetrically from the first half and the second half of the tool head. Although the handles may be at any angle between about −90 degrees to about 90 degrees, the handles in FIG. 25 are shown at a 45 degree angle in comparison to the symmetric handles shown in FIG. 1D. In other embodiments, the tool head is rotated to the left or to the right within the pivot plane with respect to the handles. In yet other embodiments, the tool head is rotated along its horizontal axis and its vertical axis with respect to the handles. In some embodiments, the handles 260 are formed as upwardly curved extensions 268 of the bottom 262 of the tool head 264, where the upward portions form a striking surface 269 of a hammer tap, as shown in FIG. 26. Alternatively, a striking surface 265 may be formed on any upward facing part of the tool head 264 or handles, including the surfaces of a hammer tap 266 extending from the top of the tool head 264, as shown in FIG. 26. Alternatively, the striking surface may be formed on any bottom or downward facing part of the tool head or handles. In other embodiments, the rearward-facing surfaces 223, 273 of the tool head 224, 274 are substantially flat and perpendicular to the pivot plane such that these surfaces form the striking surface, as shown in FIGS. 22 and 27, respectively. The rearward-facing surfaces may form a rounded edge 225 or a sharp edge 275 in forming a right angle with the bottom surfaces 222, 272 of the tool head in these embodiments. In some embodiments, the handles extend asymmetrically from the tool head. FIG. 28*a* shows one handle 280 extending only directly rearward and the other handle angling to the left 281 while extending rearward. FIG. 28*e* shows one handle 280 extending only directly rearward and the other handle angling to the right 282 while extending rearward. Alternatively, the handles may both extend at an angle to the right or to the left or the handles may both extend at angles that are different from each other, as shown in FIGS. 28*b*-*d*. The handles also may have different lengths, curvatures, or shapes within the spirit of the present invention.

Figure 29:
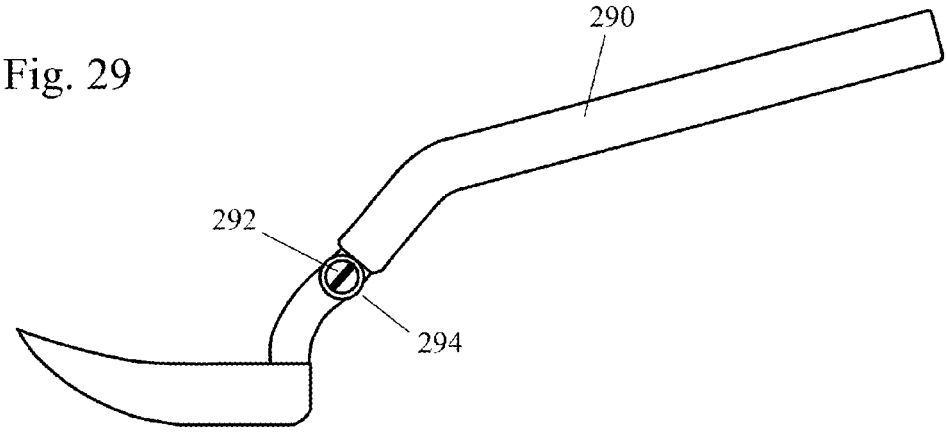
FIG. 29 shows a side view of a fastener extraction tool with adjustable handles in an embodiment of the present invention.

In some embodiments, the handles are adjustable. In FIG. 29, each handle 290 includes a fastener 292 and a pivot point 294 to rotate the handle with respect to the tool head, thereby adjusting the angle at which the handle extends rearward. The fastener 292 is preferably a screw or bolt. The pivot angle is adjusted by loosening the fastener, moving the handle to a new or desired position, and tightening the fastener.

Figure 31:
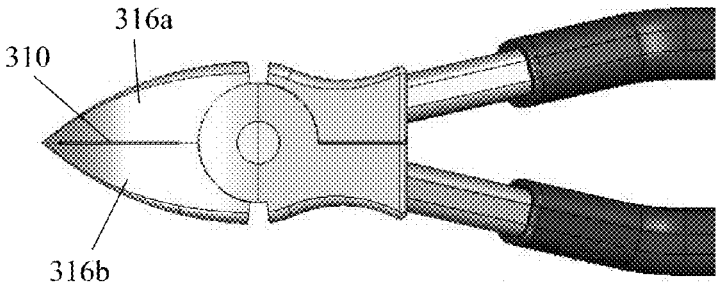
FIG. 31 shows a top view of a fastener extraction tool with a uniform gap between the forward jaws in an embodiment of the present invention.
Figure 30:
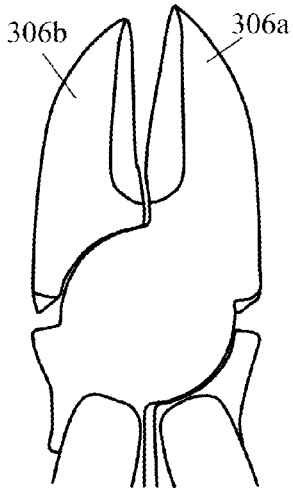
FIG. 30 shows a top view of a fastener extraction tool with asymmetric forward jaws in an embodiment of the present invention.
Figure 32:
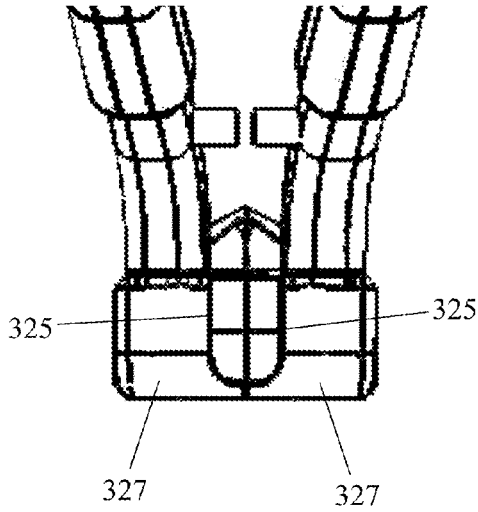
FIG. 32 shows a back view of a fastener extraction tool with a U-shape formed by upper surfaces of the rearward jaws in an embodiment of the present invention.
Figure 33:
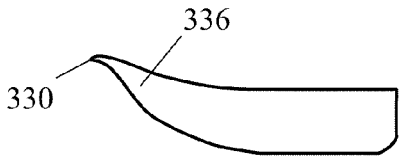
FIG. 33 shows a side view of a tool head of a fastener extraction tool with tips angled below the horizontal in an embodiment of the present invention.

The forward and rearward jaws may be alternatively arranged within the spirit of the present invention. In one embodiment, the right jaw 306*a* and the left jaw 306*b* have different lengths, as shown in FIG. 30. In other embodiments, the right jaw and left jaw may have different shapes. In some embodiments, the right jaw and left jaw are formed such that they do not meet when the tool is in a closed position. In some embodiments, a large uniform gap is formed between the left and right jaws when the tool is in the closed position. The large uniform gap preferably has an aspect ratio (length: width) of 5:1 or less. In some embodiments, the aspect ratio is less than 2:1. In other embodiments, a small uniform gap 310 is formed between the right jaw 316*a* and left jaw 316*b* when the tool is in the closed position, as shown in FIG. 31. The small uniform gap 310 preferably has an aspect ratio greater than 5:1. In some embodiments, the aspect ratio is greater than 10:1. In some embodiments, the aspect ratio is greater than 30:1. In some embodiments, upper surfaces 325 of the jaws 327 form a U-shape when the tool is in a closed position, as shown in FIG. 32. In some embodiments, the tips 330 of the forward jaws 336 may extend downward or at an angle below horizontal, as shown in FIG. 33. In some embodiments, the sharp tips of the forward jaws extend to the left or right instead of straight ahead from the tool head.

Figure 34:
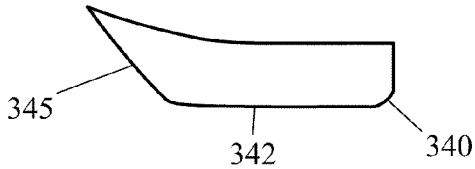
FIG. 34 shows a side view of a tool head of a fastener extraction tool with a flat front bottom surface in an embodiment of the present invention.
Figure 35:
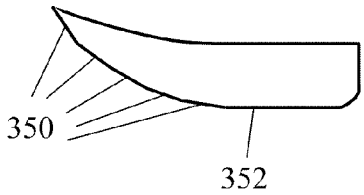
FIG. 35 shows a side view of a tool head of a fastener extraction tool with a series of flat front bottom surfaces in an embodiment of the present invention.
Figure 36:
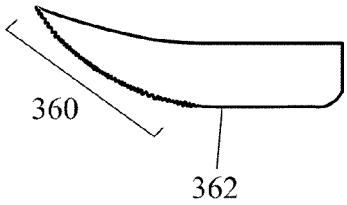
FIG. 36 shows a side view of a tool head of a fastener extraction tool with bumpy front bottom surfaces in an embodiment of the present invention.

The profile of the bottom surface of the tool head may be alternatively arranged within the spirit of the present invention. The profile may have any form, which allows at least a portion of the bottom surface to serve as a fulcrum during extraction of a fastener by lever action using the handles and forward or rearward jaws. A tool head of the present invention preferably has any shape to its bottom surfaces which allows the bottom surfaces to be used as a moving fulcrum on a workpiece surface during extraction of a fastener. While the bottom surface of the pivot portion of the tool head may be curved or flat, the bottom surfaces of the forward jaws preferably slope generally upward as an extension of the bottom surface of the pivot portion such that the moving fulcrum has a continuous range of motion for rolling contact with the workpiece from a portion of the upwardly-sloped bottom surfaces of the forward jaws to at least a portion of the pivot portion. In some embodiments, the bottom surface 342 includes a curved portion 340 and a flat portion 345 angling upward toward the front of the tool, as shown in FIG. 34. In some embodiments, a portion of the bottom surface 352 includes substantially flat surfaces 350 progressively sloping upward toward the front or back of the tool head, as shown in FIG. 35. In some embodiments, a portion of the bottom surface 362 includes a bumpy or irregular profile 360 generally sloping upward toward the front or back of the tool head, as shown in FIG. 36. The bottom surface of the tool head may be smooth with a low coefficient of friction or may be rough or have a coating to increase the coefficient of friction of the surface to reduce slippage of the tool head against the workpiece.

In the following embodiments of FIG. 37 and FIG. 38, the fastener extraction tool grasps the fastener laterally from above on a vertical plane with the jaws, rather than grasping from the sides on a horizontal plane as in the other embodiments described herein. Instead of a bottom surface including both of the jaws, in the following two embodiments, an outer surface of one of the jaws is used as the moving fulcrum during the extraction. The tips of the jaws preferably protrude from the jaws for use in combination with the striking surface for digging into the workpiece around an embedded fastener.

Figure 37:
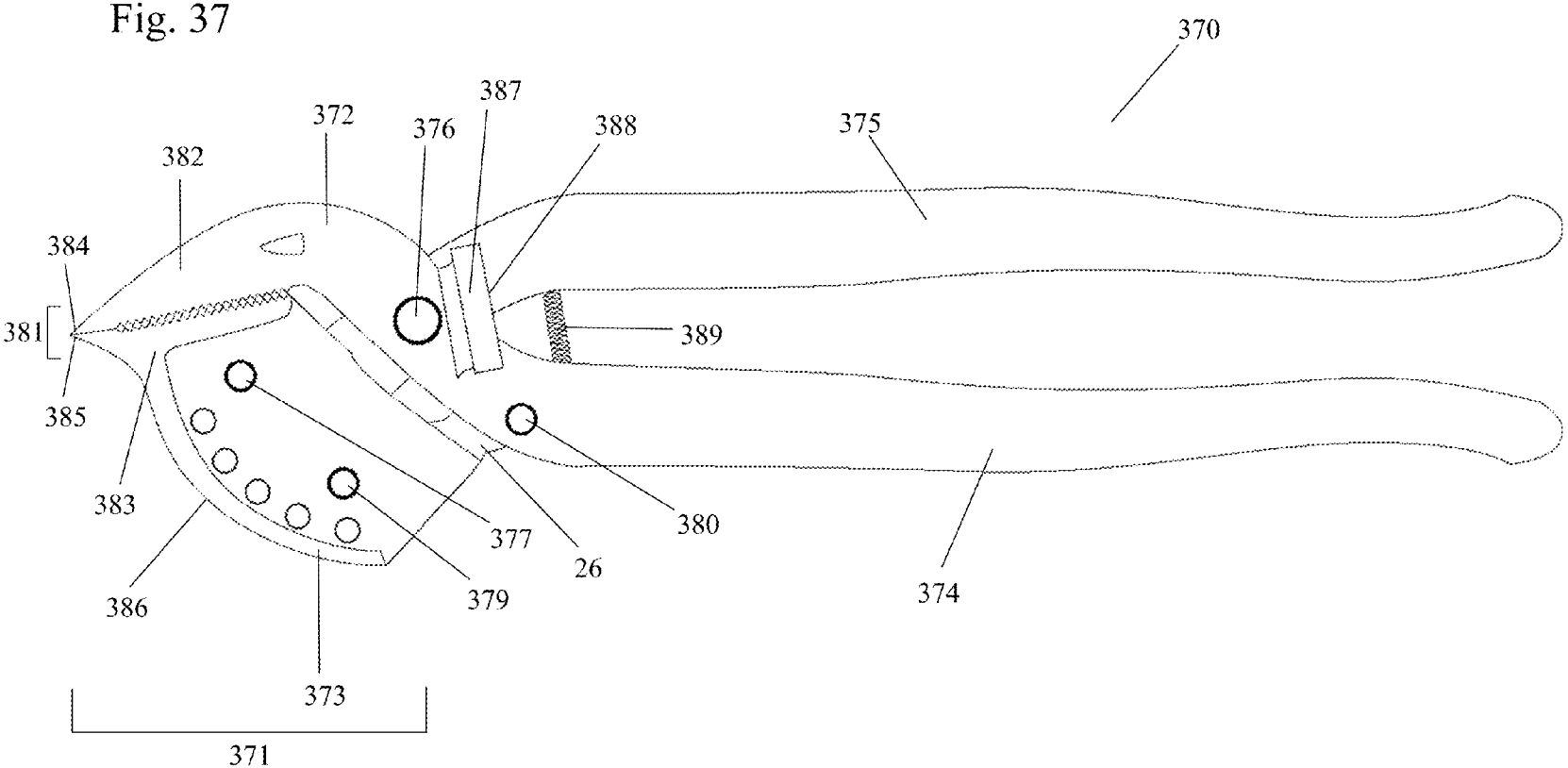
FIG. 37 shows a fastener extraction tool with a fulcrum on the lower jaw and a hammer tap in an embodiment of the present invention.

FIG. 37 shows a fastener extraction tool 370 including a tool head 371 with a first half 372 and a second half 373 pivotally connected. The first half 372 includes an integral first handle 374 extending rearward and pivotally connected to a second handle 375 at a first pivot 376. The second half of the tool head is pivotally connected to the second handle 375 by a second pivot 377. The second half is also pivotally connected to a pivot arm 378 at a third pivot 379, and the pivot arm is pivotally connected to the first handle at a fourth pivot 380. Actuating the handles opens and closes a pair of jaws 381 formed from forward extending portions of the tool head. The top jaw 382 and the bottom jaw 383 extend to sharp tips 384, 385, respectively, at the front of the tool. The second half of the tool head includes a convex curved surface 386 facing outward. The tool also includes a hammer strike 387 extending rearward from the first handle behind the first pivot. The hammer strike includes a substantially rearward facing striking surface 388 such than striking the striking surface drives the tips into a workpiece to allow the jaws to grab a fastener embedded in the workpiece. The tool also includes a spring 389 biasing the handles 374, 375 away from each other.

The tips 384, 385 extend forward from the general shape of the jaws with a relatively small cross sectional area so that a hammer tap to the striking surface drives the tips below the surface of a workpiece to the depth of an embedded fastener while minimizing the damage to the workpiece. The opposing inwardly facing surfaces of the jaws are then used to grab the fastener. Rotating the handles downward causes the curved surface 386 to contact the workpiece. This contact point serves as a moving fulcrum to allow the handles to work as a lever with the jaws to extract the fastener from the workpiece. The curved surface 386 has a sufficient width to provide a line of contact with the workpiece in order to distribute the force to the workpiece across the width of the tool and minimize damage to the workpiece as the curved surface contacts and rolls along the workpiece during the extraction.

Figure 38:
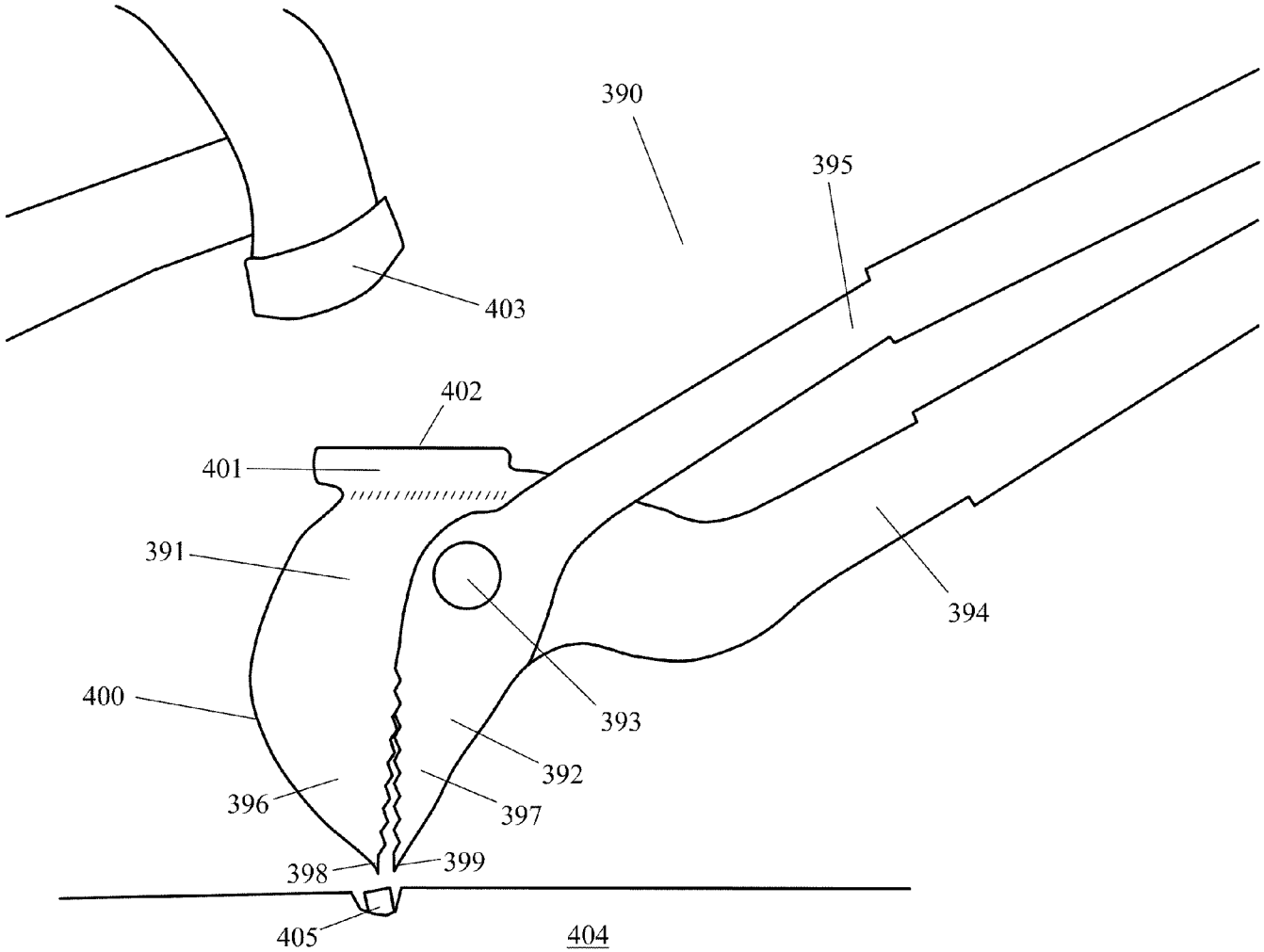
FIG. 38 shows a fastener extraction tool with a fulcrum on the upper jaw and a hammer tap in an embodiment of the present invention.

FIG. 38 shows a fastener extraction tool 390 including a tool head with a first half 391 and a second half 392 pivotally connected at a first pivot 393. The first half 391 includes an integral first handle 394 extending rearward. The second half 392 includes an integral second handle 395 extending rearward. Actuating the handles opens and closes a pair of jaws 396, 397 formed from forward extending portions of the tool head. The top jaw 396 and the bottom jaw 397 extend to sharp tips 398, 399, respectively, at the front of the tool. The first half of the tool head includes a convex curved surface 400 facing outward. The tool also includes a hammer strike 401 extending rearward from the first handle behind the first pivot. The hammer strike includes a substantially upward facing striking surface 402 such than striking the striking surface with, for example, a hammer 403 drives the tips into a workpiece to allow the jaws to grab a fastener embedded in the workpiece.

The tips 398, 399 extend forward from the general shape of the jaws with a relatively small cross sectional area so that a hammer tap to the striking surface drives the tips below the surface of a workpiece 404 to the depth of an embedded fastener 405 while minimizing the damage to the workpiece. Striking downward utilizing the hammer tap preferably drives the tips of the tool below the surface of the workpiece such that pulling upward on the lower handle 394 causes the jaws to grip very tightly as the fulcrum rolls along the horizontal wood. The opposing inwardly facing surfaces of the jaws are then used to grab the fastener. Rotating the handles upward causes the curved surface 400 to contact the workpiece. This moving contact point serves as a fulcrum to allow the handles to work as a lever with the jaws to extract the fastener from the workpiece. The curved surface 400 has a sufficient width to provide a line of contact with the workpiece in order to distribute the force to the workpiece across the width of the tool and minimize damage to the workpiece as the curved surface contacts and rolls along the workpiece during the extraction. In some embodiments, the gap between the jaws is adjustable.

Figure 39A:
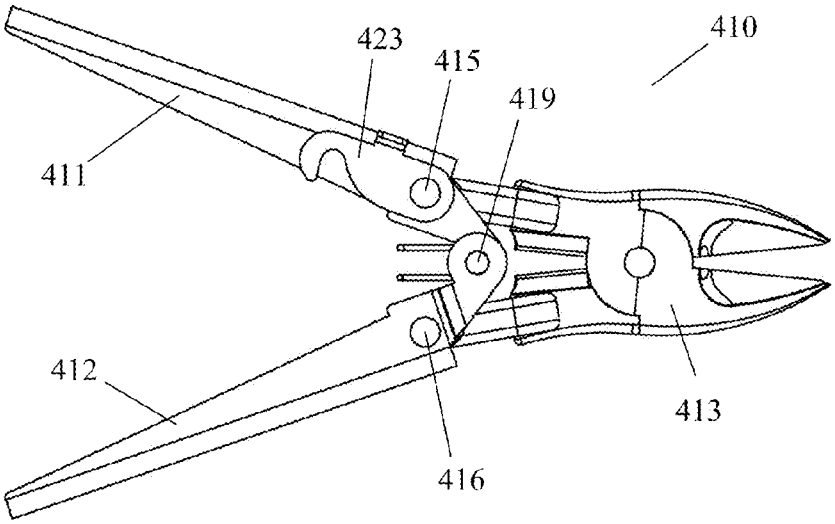
FIG. 39*a* shows a top view of a fastener extraction tool with compound pivots for the handles in an embodiment of the present invention.
Figure 39B:
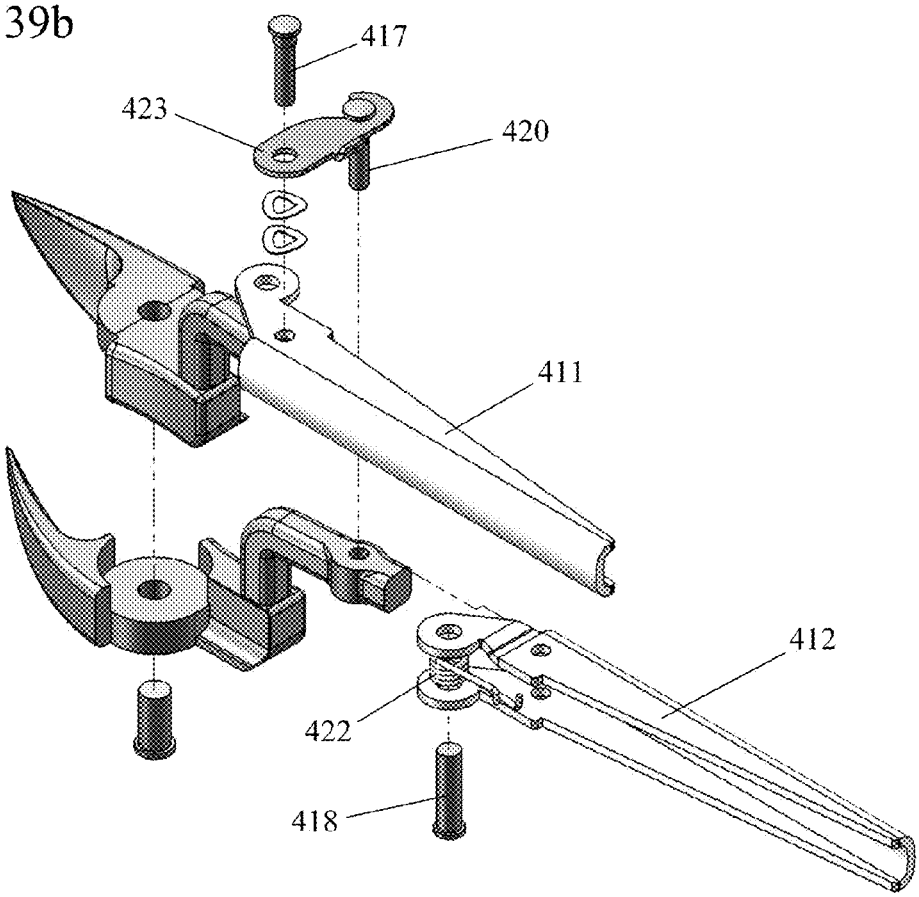
FIG. 39*b* shows a partial exploded view of the fastener extraction tool of FIG. 39*a*.

FIG. 39*a* and FIG. 39*b* show a fastener extraction tool 410 with compound handles 411, 412 to provide a compound leverage action between the tool head 413 and the handles. In this embodiment, each half of the tool head is pivotally linked to one of the handles 411, 412 at a pivot 415, 416 held together by a pin 417, 418, respectively. The handles are pivotally linked to each other at a third pivot point 419, held together by a pin 420 and located forward of the first two pivots 415, 416. The first pivot 415 and the second pivot 416 also include torsion springs 422 (only one shown). In this embodiment, a latch 423, pivotable about the first pin 415, may be latched around the second pin 416 to hold the tool 410 in a closed position.

Figure 40:
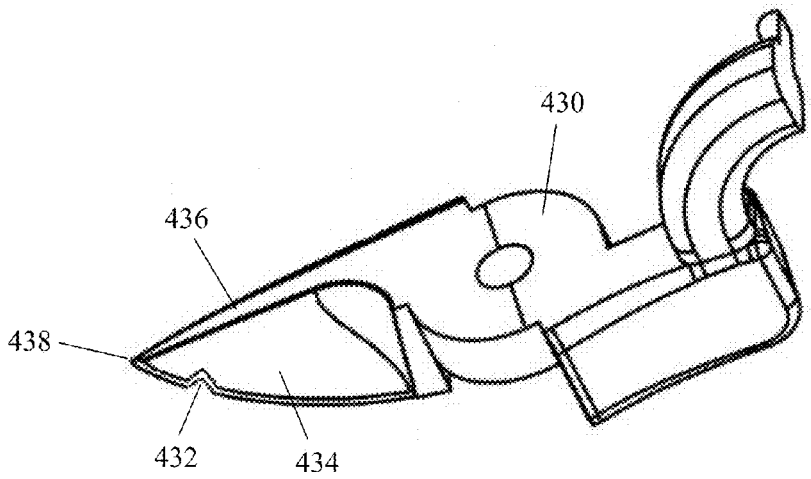
FIG. 40 shows a partial view of a fastener extraction tool with a notch in a forward jaw.

FIG. 40 shows half 410 of a tool head of a fastener extraction tool with a notch 432 in the gripping surface 434 of the forward jaw 436. The notch 432 is preferably located toward the tip 438 of the forward jaw. The notch 432 provides different angles of the gripping surface to grip a fastener without cutting the fastener during extraction of the fastener from a workpiece. In some embodiments, the notch is sized to permit gripping of a fastener without cutting with the forward jaws in a fully closed position for extraction of the fastener. In some embodiments, the notch is located on only one of the forward jaws. In other embodiments, the forward jaws both have notches. In some embodiments, the notches have the same shape and location on the forward jaws. In other embodiments, the notches have different shapes or different locations on the forward jaws. The notch may have any shape which provides different angles of the gripping surface to grip a fastener without cutting the fastener during extraction of the fastener including, but not limited to, a half-diamond shape such that a diamond-shaped hole is formed when two forward jaws with half-diamond shapes are in a closed position, a curved shape, a half-circular shape, a half-oval shape, a half-elliptical shape, a multi-lined shape, or an irregular shape.

Figure 41:
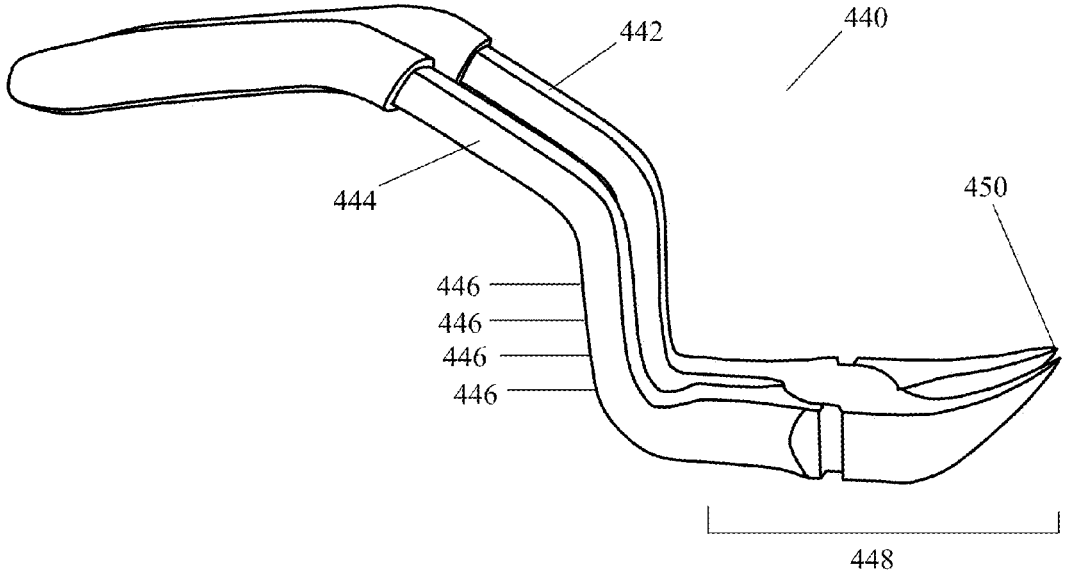
FIG. 41 shows a perspective view of a fastener extraction tool with striking surfaces on the handles behind the tool head in an embodiment of the present invention.

FIG. 41 shows a fastener extraction tool 440 with handles 442, 444 having large striking surface areas 446 behind the tool head 448. The striking surface areas allow the user to easily drive the tips 450 of the tool head into a workpiece with an embedded nail by a hammer strike or other force to the striking surface areas. The striking surface areas are preferably located behind the tool head and are preferably oriented rearward to promote a forward force upon striking. In the embodiment of FIG. 41, the handles are formed integrally with their respective tool head halves.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A fastener extraction tool comprising:

a) a tool head comprising:

a pivot portion:

a first half comprising:

a first forward extending portion extending longitudinally forward beyond the pivot portion, the first forward extending portion forming a first forward jaw having a first gripping surface formed on a first inward side of the first forward extending portion; and a first rearward extending portion extending longitudinally rearward beyond the pivot portion;

a second half pivotally joined to the first half at the pivot portion, the second half comprising:

a second forward extending portion extending longitudinally forward beyond the pivot portion, the second forward extending portion forming a second forward jaw having a second gripping surface formed on a second inward side of the second forward extending portion; and a second rearward extending portion extending longitudinally rearward beyond the pivot portion;

the tool head having a bottom surface formed by the first forward extending portion and the second forward extending portion and sloping longitudinally upward from a bottom surface of the pivot portion;

b) a first handle extending from the first rearward extending portion and having a first gripping portion; and c) a second handle extending from the second rearward extending portion and having a second gripping portion;

wherein actuating the handles causes the pivot portion to rotate and the forward jaws to open and close; and wherein the bottom surfaces are formed to provide a range of motion of a longitudinally-moving fulcrum of rolling contact with a workpiece from a bottom surface of the forward extending portions to at least the edge of the bottom surface of the pivot portion of the tool head during extraction of a fastener embedded in the workpiece and gripped by the forward jaws.

2. The fastener extraction tool of claim 1, wherein the first handle extends from a surface of the first rearward extending portion selected from the group consisting of a top surface, a rear surface, and an outward side surface, and the second handle extends from a surface of the second rearward extending portion selected from the group consisting of a top surface, a rear surface, and an outward side surface.

3. The fastener extraction tool of claim 1, wherein the first handle and the second handle extend vertically from the tool head.

4. The fastener extraction tool of claim 1, wherein the first handle and the second handle extend forward from the tool head.

5. The fastener extraction tool of claim 1, wherein the first handle and the second handle extend asymmetrically from the tool head.

6. The fastener extraction tool of claim 1, wherein the first handle is formed integrally with the first rearward extending portion and the second handle is formed integrally with the second rearward extending portion.

7. The fastener extraction tool of claim 1 further comprising a first adjustment pivot located on the first handle and a second adjustment pivot on the second handle to adjust the angles of the gripping portions of the handles with respect to the tool head.

8. The fastener extraction tool of claim 1, wherein the forward extending portions taper in at least one dimension to tips, the tool further comprising at least one striking surface formed on a top surface of the tool head such that a striking force applied to the striking surface drives the tips under a fastener embedded in a surface.

9. The fastener extraction tool of claim 1, wherein the forward extending portions taper in at least one dimension to tips, the tool further comprising at least one striking surface located on a rearward surface of one of the handles below the gripping portion such that a striking force applied to the striking surface drives the tips under a fastener embedded in a surface.

10. The fastener extraction tool of claim 1, wherein at least one of the forward extending portions tapers in at least one dimension to a tip, wherein the tip extends from the forward extending portion below a horizontal plane.

11. The fastener extraction tool of claim 1, wherein at least one of the forward extending portions tapers in at least one dimension to a tip, wherein the tip extends from the forward extending portion toward the side.

12. The fastener extraction tool of claim 1, wherein the first half and the second half of the tool head are asymmetrical.

13. The fastener extraction tool of claim 1, wherein forward extending portions are formed to provide a uniform gap between the first forward jaw and the second forward jaw when the fastener extraction tool is in a closed position.

14. The fastener extraction tool of claim 1, wherein the forward jaws form a u-shaped surface when the fastener extraction tool is in a closed position.

15. The fastener extraction tool of claim 1, wherein the first rearward extending portion forming a first rearward jaw and the second rearward extending portion forming a second rearward jaw, wherein the rearward jaws form a u-shaped surface when the fastener extraction tool is in a closed position.

16. The fastener extraction tool of claim 1, wherein the bottom surfaces of the forward extending portions have a longitudinal profile selected from the group consisting of a plurality of straight portions, a plurality of curved portions, and at least one straight portion and at least one curved portion.

17. The fastener extraction tool of claim 1, wherein at least one of the forward jaws has a notch formed such that the notch provides different angles of the gripping surface to grip the fastener without cutting the fastener during extraction of the fastener from the workpiece using the forward jaws.

18. A fastener extraction tool comprising:

a) a tool head comprising:

a pivot portion:

a first half comprising:

a first downward extending portion extending longitudinally downward beyond the pivot portion, the first downward extending portion tapering in at least one dimension to a first tip to form a first sharp implement;

the first downward extending portion forming a first downward jaw having a first gripping surface formed on a first inward side of the first downward extending portion; and a second half pivotally joined to the first half at the pivot portion, the second half comprising:

a second downward extending portion extending longitudinally downward beyond the pivot portion;

a second downward extending portion extending longitudinally downward beyond the pivot portion, the second downward extending portion tapering in at least one dimension to a second tip to form a second sharp implement;

the second downward extending portion having a bottom surface sloping longitudinally away from the second tip;

b) a first handle extending upward from the first half and having a first gripping portion; and c) a second handle extending upward from the second half and having a second gripping portion;

wherein actuating the handles causes the pivot portion to rotate and the downward jaws to open and close; and wherein a fulcrum on the bottom surface of the second downward extending portion moves in relation to the surface of a workpiece as the handles are moved parallel to the plane of the workpiece during extraction of a fastener from the workpiece using the downward jaws.

19. The fastener extraction tool of claim 18 further comprising at least one striking surface extending from an upward surface of the tool head such that a striking force applied to the striking surface drives the tips under the fastener embedded in the surface.

* * * * *